US006722709B2

(12) United States Patent
Bergdoll

(10) Patent No.: US 6,722,709 B2
(45) Date of Patent: Apr. 20, 2004

(54) COVER HOLDER

(76) Inventor: James Bergdoll, 3 Conscience Cir., Strongs Neck, Setauket, NY (US) 11733

( * ) Notice: Subject to any disclaimer, the term of this patent is extended or adjusted under 35 U.S.C. 154(b) by 0 days.

(21) Appl. No.: 10/219,435

(22) Filed: Aug. 15, 2002

(65) Prior Publication Data

US 2003/0230900 A1 Dec. 18, 2003

Related U.S. Application Data

(63) Continuation-in-part of application No. 10/170,057, filed on Jun. 12, 2002.

(51) Int. Cl.[7] ..... B65D 45/30
(52) U.S. Cl. ..... 292/1; 292/258; 292/DIG. 11
(58) Field of Search ..... 292/1, 253, 258, 292/DIG. 30, DIG. 11, DIG. 16; 16/425, 111.1, 428

(56) References Cited

U.S. PATENT DOCUMENTS

| | | | | | |
|---|---|---|---|---|---|
| 356,116 | A | * | 1/1887 | Garfield | 24/129 B |
| 1,806,162 | A | * | 5/1931 | Hahn | 24/712.6 |
| 2,146,415 | A | * | 2/1939 | Bradley | 220/753 |
| 3,677,543 | A | * | 7/1972 | Richardson | 482/129 |
| 3,731,964 | A | * | 5/1973 | Hyde | 292/258 |
| 3,768,711 | A | * | 10/1973 | Wilkinson | 294/149 |
| 3,912,140 | A | * | 10/1975 | Franges | 294/166 |
| 4,009,897 | A | * | 3/1977 | Spellman | 292/258 |
| 4,124,922 | A | * | 11/1978 | Speedie | 24/115 R |
| 4,366,596 | A | * | 1/1983 | Hellinger et al. | 220/753 |
| 4,428,577 | A | * | 1/1984 | Weingardt | 482/126 |
| 4,691,840 | A | * | 9/1987 | Ferbrache | 220/318 |
| 4,733,862 | A | * | 3/1988 | Miller | 482/126 |
| 4,762,318 | A | * | 8/1988 | Phillips et al. | 482/126 |
| 4,779,867 | A | * | 10/1988 | Hinds | 482/126 |
| 4,791,702 | A | * | 12/1988 | McVey | 16/428 |
| 4,819,827 | A | * | 4/1989 | DiSesa | 220/318 |
| 4,982,989 | A | * | 1/1991 | Sweeny | 294/171 |
| 5,052,681 | A | * | 10/1991 | Williams | 482/121 |
| 5,297,692 | A | * | 3/1994 | Kronmiller | 220/318 |
| 5,556,368 | A | * | 9/1996 | Akin | 482/124 |
| 5,682,652 | A | | 11/1997 | Brody et al. | |
| 5,758,914 | A | * | 6/1998 | Ioveno | 292/288 |
| 5,813,954 | A | * | 9/1998 | Wilkinson | 482/124 |
| 6,049,948 | A | * | 4/2000 | Leonardi | 16/428 |
| 6,237,820 | B1 | * | 5/2001 | Saxton | 224/148.5 |
| 6,317,935 | B1 | * | 11/2001 | O'Rouke | 24/129 R |
| 6,390,959 | B1 | * | 5/2002 | Tornabene et al. | 482/126 |
| 6,405,409 | B1 | * | 6/2002 | Zirella | 16/421 |

* cited by examiner

*Primary Examiner*—William L. Miller
*Assistant Examiner*—Thomas Ho
(74) *Attorney, Agent, or Firm*—Keusey, Tutunjian & Bitetto, P.C.

(57) ABSTRACT

A cover holder includes a handle including an engagement structure configured and dimensioned for engaging a container structure formed on a container. The engagement structure extends from a portion of the handle for detachably fitting the container structure. The handle includes anchor portions each having a plurality of holes for receiving at least one flexible tension member to connect the flexible tension member to the handle. The plurality of holes are arranged to permit the at least one flexible tension member to develop a frictional force to prevent pull out of the flexible tension member from the anchor portions.

14 Claims, 37 Drawing Sheets

COVER HOLDER

RELATED APPLICATION DATA

This application is a continuation-in-part of copending application Ser. No. 10/170,057 filed Jun. 12, 2002.

BACKGROUND

1. Technical Field

This disclosure relates to an apparatus for securing components together, and more particularly, to a cover holding device and features related thereto for more easily securing a cover or lid to a container.

2. Description of the Related Art

Lid retaining and securing mechanisms have been employed in conventional systems to secure a lid or cover on a container. These systems have employed devices such as springs or BUNGEE cords equipped with hooks to secure these devices to a container such as a garbage can. The hooks of these devices are secured by the handles on the container and are stretched over the top of the lid. Unfortunately, the springs and/or BUNGEE cords are often an unacceptable length and need to be doubled up or otherwise configured to provide the correct length for securing the lid. In addition, the standard hooks or clamps for the springs or cords are typically not properly dimensioned. Multiple hooks and cords are cumbersome and often only secure a portion of the lid.

Another disadvantage to using hooks on the springs/BUNGEE cords is that the hooks are easily disengaged from the container handles by a raccoon or other animal attempting to access the contents of the container.

Therefore, a need exists for an apparatus for securing a lid or cover to a container. A further need exists for providing a device or devices for adjusting the length of a flexible retaining or securing member to provide a desired tension for securing the lid or cover. A need also exists for a more ergonomic handle for ease of securing and removal of the securing device to/from a container.

SUMMARY OF THE INVENTION

A cover holder includes a handle configured and dimensioned for engaging a container structure formed on a container. The handle includes an engagement structure extending from a portion of the handle for detachably fitting the container structure. A flexible tension member is connected to the handle, and the flexible tension member anchors to the container structure through use of the handle. The flexible tension member thereby secures a cover on the container.

In other embodiments, the engagement structure may be removable from the handle and may be replaceable to accommodate different sized structures. The engagement structure itself may be adjustable to accommodate different sized structures. The holder may include an adjustment mechanism, and the adjustment mechanism may further include a plurality of positions. Each position secures the flexible member such that a tension or length of the adjustable member is changed when secured at each of the positions. The adjustment mechanism may attach to the cover to be secured on the container. The holder may further include a guard structure for placement over the cover. The guard structure may be formed to capture the at least one flexible member such that the guard structure secures the cover to the container when the handle is secured to the structure of the container. The adjustment mechanism may be attached directly to the cover. The handle may include anchor portions which capture and secure at least one flexible member therein. The anchor portions may include a release mechanism, which selectively secures and releases the flexible member to permit tensioning of the flexible member. The handle may include a plurality of positions for securing an end portion of the at least one flexible member. Each position corresponds to a different tension of the flexible member when the flexible member is secured at that position.

Another cover holder includes a handle structure including a surface configured and dimensioned for contacting a container structure. The handle structure includes a handle portion and a pivot axis disposed between the surface and the handle portion. At least one flexible tension member is pivotally connected to the handle structure at the pivot axis, the at least one flexible tension member for being anchored to the structure by at least one handle structure. The flexible member secures a cover on the container, and the pivot axis is offset from the surface to provide a lever force, which resists disengagement of contact between the surface and the container structure when in use.

In other embodiments, the surface is concave to engage the container structure. The holder may include an adjustment mechanism, the adjustment mechanism including a plurality of positions, each position for securing the flexible member such that a tension or length of the adjustable member is changed when secured at each of the positions. The adjustment mechanism may attach directly to the cover to be secured on the container. The holder may include a guard structure for placement over the cover. The guard structure is formed to capture the at least one flexible member such that the guard structure secures the cover to the container when the handle is secured to the structure of the container.

Yet another cover holder includes at least two pivot arms pivotally attached to one of a container structure and a cover for the container structure. A locking bar is disposed between the pivot arms and is slidably coupled to the pivot arms. The locking bar includes an engagement structure for contacting the other of the container structure and the cover. A handle connects the pivot arms and supports a biasing device, which biases the locking bar to selectively provide a locked position and a release position for the locking bar. The locked position corresponds to securing the cover and the release position corresponds to enabling the cover to be released.

Another embodiment of the cover holder provides a rotating lock having an inner surface with an oblong cross-section. The inner surface encapsulates a portion of the handle and a portion of the locking bar such that rotation of the rotating lock displaces the locking bar and achieves the locked position in a first rotational position and the release position in a second rotational position. Detents or other surface features may be formed on the inner surface to secure the locking bar in position.

A cover holder, in accordance with another aspect of the present invention, includes a handle including an engagement structure configured and dimensioned for engaging a container structure formed on a container. The engagement structure extends from a portion of the handle for detachably fitting the container structure. The handle includes anchor portions each having a plurality of holes for receiving at least one flexible tension member to connect the flexible tension member to the handle. The plurality of holes are arranged to permit the at least one flexible tension member to develop a frictional force to prevent pull out of the flexible tension member from the anchor portions.

In alternate embodiments, the engagement structure may be removable from the handle and replaceable to accommodate different sized structures, or the engagement structure may be adjustable to accommodate different sized structures. The anchor portions may include a groove for pinching the flexible tension member. Anchor portions may include an extended portion adjacent to one of the plurality of holes, which forms a groove for pinching the flexible tension member. The groove may include a structure to increase friction between the groove and the flexible tension member. The plurality of holes may be linearly arranged on each anchor portion. One of the plurality of holes may form a groove for pinching the flexible tension member.

In another aspect of the present invention, a handle includes an engagement structure configured and dimensioned for engaging a container structure formed on a container. The engagement structure detachably fits the container structure. Anchor portions are disposed on opposite sides of the engagement structure, and each anchor portion includes at least two holes. The holes are disposed adjacent to one another. One of the holes of each anchor portion includes a groove for receiving at least one flexible tension member to connect the flexible tension member to the handle. The groove permits the at least one flexible tension member to develop a frictional force to prevent pull out of the flexible tension member from the anchor portions.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present invention provides a plurality of devices for securing a lid or cover on a container. In one embodiment, the device is employed on a garbage receptacle with side handles. The side handles are employed to detachable engage clasping mechanisms used to secure the lid. Elastic members are attached to the clasping mechanisms to secure the device to the container and secure the cover to the container. The present invention is adaptable to a plurality of different container types. This may be provided by adjustable or replaceable device features. In addition, the elastic members are provided with an adjustment mechanism or mechanisms to provide an appropriate amount of tension and an appropriate fit for the container/cover system.

The present invention will now be described in terms of a storage or garbage receptacle; however, the present invention should not be construed as limited to the illustrative example and may be employed in other configurations with other features. For example, the present invention may be employed with storage jars or other containers, which need to be sealed or include components, which need to be secured together. In addition, the present invention preferably includes plastic hardware; however, the present invention may be employed with metals, wood or any other suitable materials or combinations thereof. It also should be understood that flexible members described herein may include flexible cords, ropes, resilient materials, such as plastics or metals, BUNGEE cords, rubber bands or equivalents. Features shown and described in the FIGS. may be used in combination with other features shown in the FIGS. or described herein below.

Figure 1:
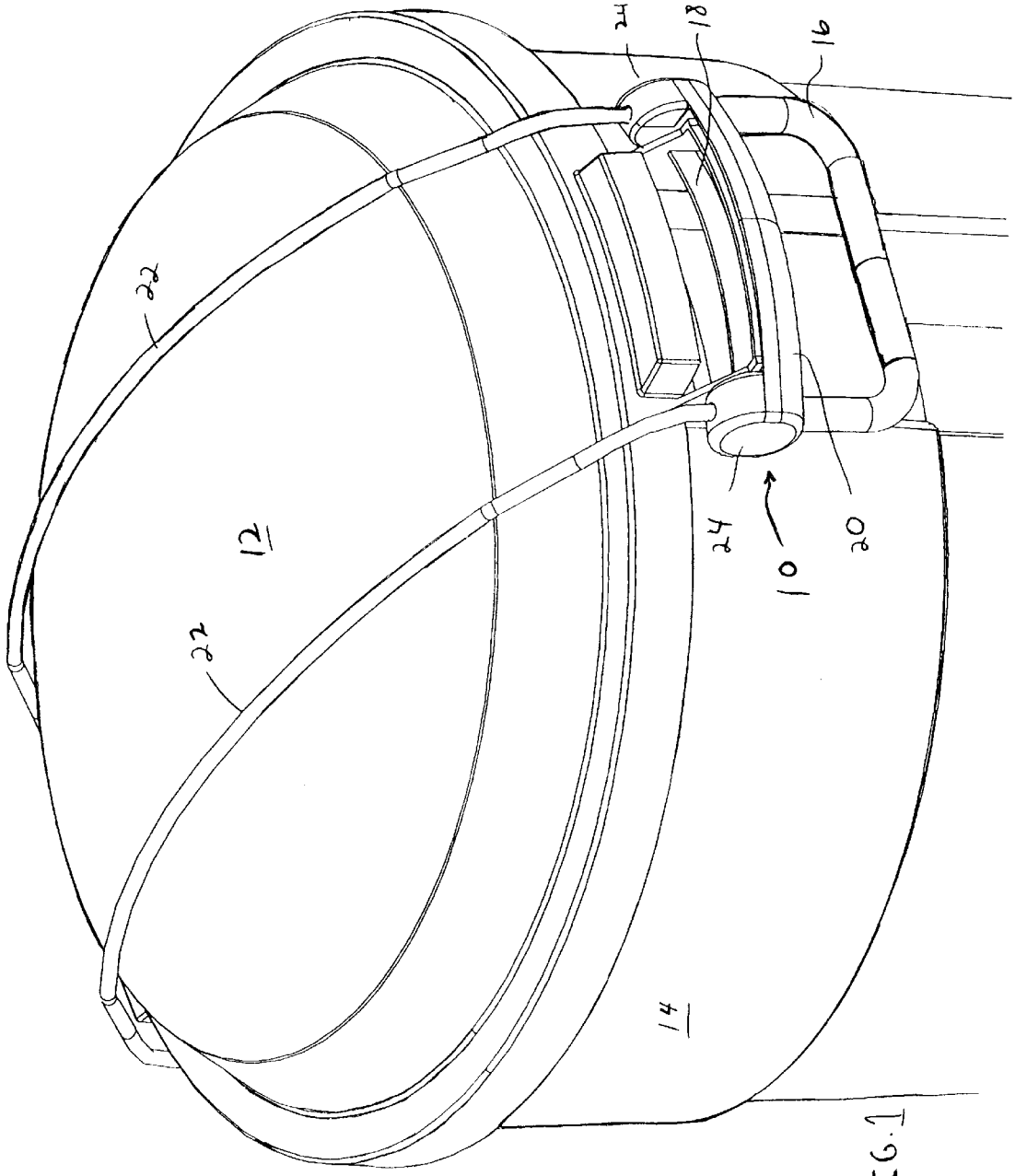
FIG. 1 is a perspective view showing a cover holder in accordance with one embodiment of the present invention.

Referring now in specific detail to the drawings in which like reference numerals identify similar or identical elements throughout the several views, and initially to FIG. 1, a device 10 for securing a cover 12 to a container 14 is shown in accordance with one embodiment of the present invention. Device 10 includes a handle 16 on each side of flexible tension members 22. Handle 16 includes an engagement portion 20, which is adapted to fit onto a handle 18 of container 14. Engagement portion 20 may include a u-shaped portion dimensioned and configured to receive at least a portion of handle 18 therein.

During use, handle 18 anchors engagement portion 20 and handle 16. Flexible members 22 are attached to handle 16 at anchor portions 24. Flexible members 22 are then stretched across lid 12 and secured to another handle 18 (not shown) on the opposite side of container 14. Alternately, one side of device 10 may be fixedly secured to container 14 and engage only one handle to secure lid 12. In other embodiments, handle 18 may engage the rim of container 14 (instead of the handle) to provide the securing function of the present invention. The handle may be secured to the rim of container 14 by tab 25 or other hooking mechanisms.

Figure 2:
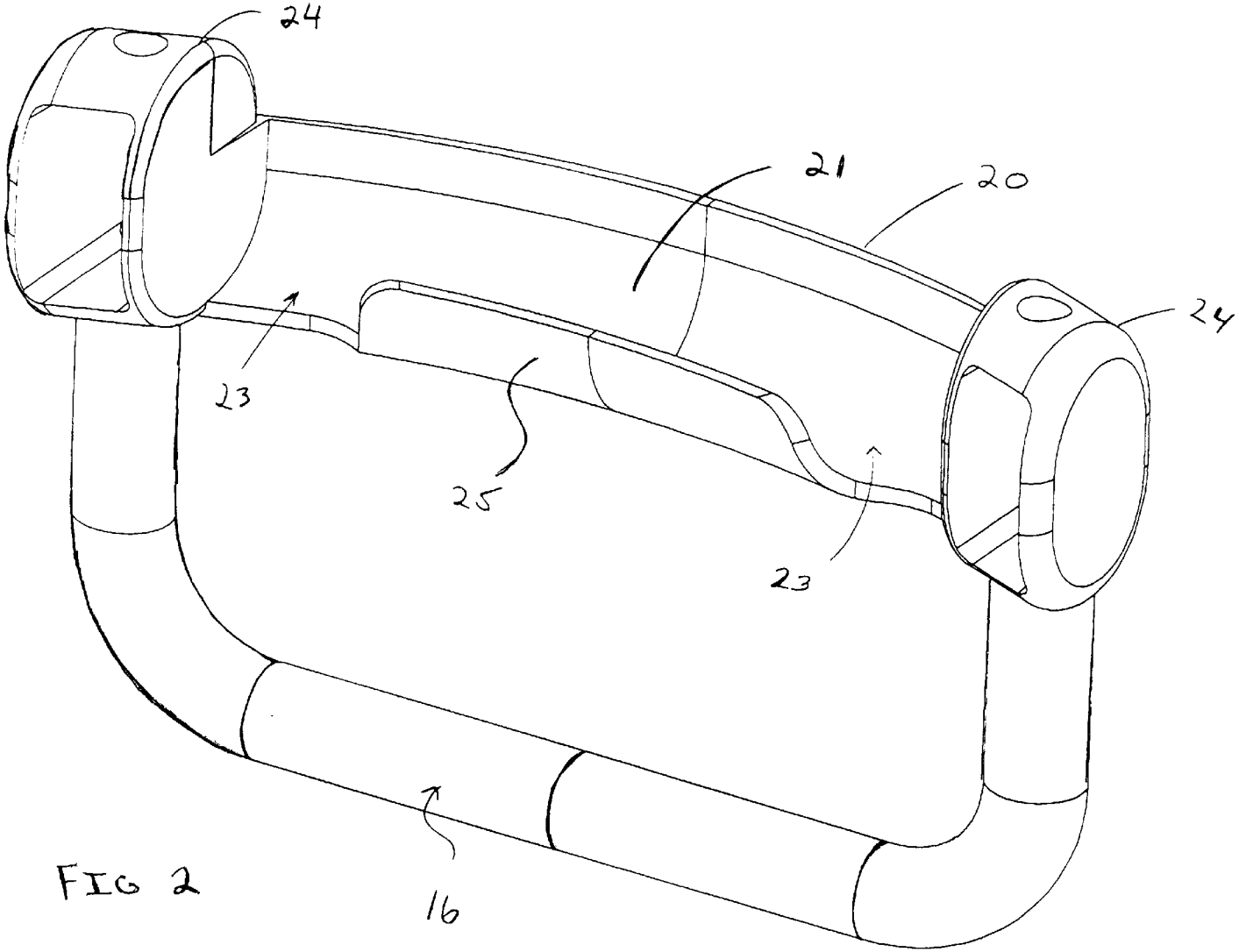
FIG. 2 is a perspective view showing a handle portion of the cover holder of FIG. 1 in accordance with the present invention.

Referring to FIG. 2, an exploded view of a handle 16 is shown. Handle 16 includes portion 20, which is configured to provide a tab 25 to capture handle 18 (FIG. 1). Portion 20 has a u-shaped portion 21 configured to receive handle 18, and further include relief portions 23 to permit returns of handle 18 to connect to container 14 (See FIG.1).

Figure 3:
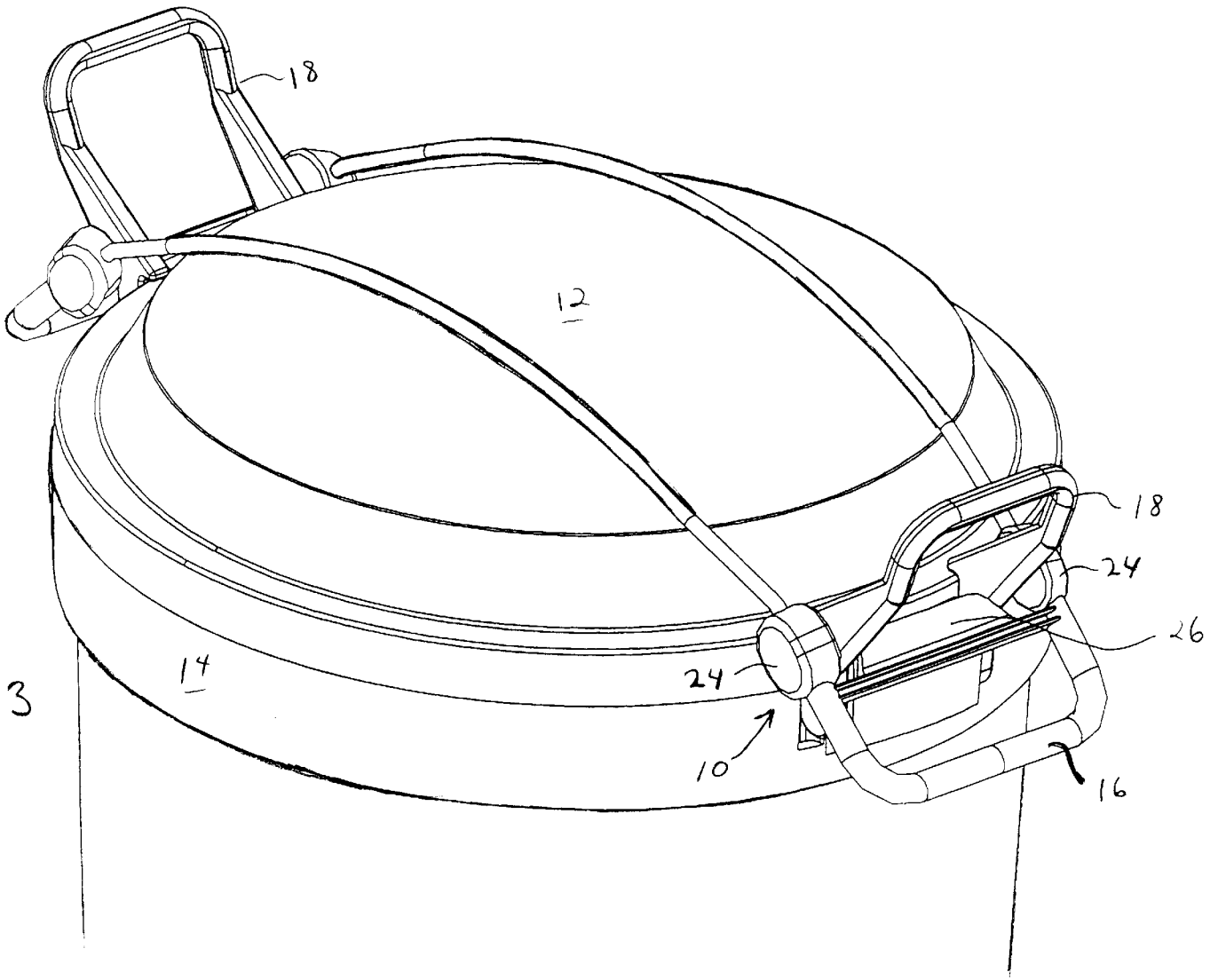
FIG. 3 is a perspective view showing a cover holder for a container with pivoting handles in accordance with another embodiment of the present invention.
Figure 4:
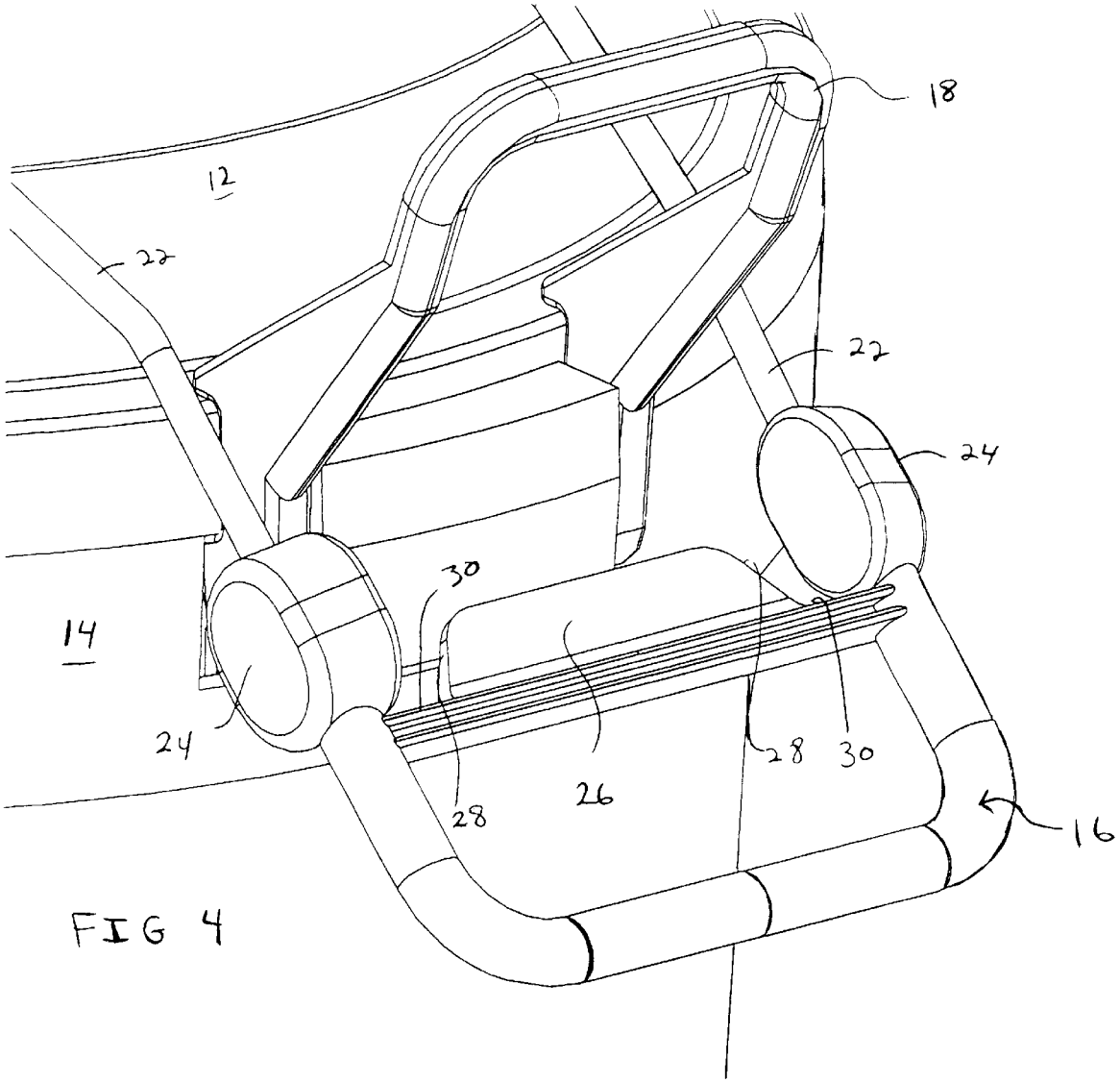
FIG. 4 is a perspective view showing a handle portion of the cover holder of FIG. 3 being released in accordance with the present invention.

Referring to FIGS. 3 and 4, another configuration for the present invention is illustratively shown. In this embodiment, handle 18 is hingedly connected to container 14 and clips onto cover 12 to secure cover 12 to container 14. Device 10 is applied directly between handles 18 and takes advantage of the inclined orientation of handles 18 to provide a stable retention arrangement. In this embodiment, handle 16 includes a tab 26 with inclined surfaces 28 for engaging handle 18.

Inclined surfaces 28 are adjacent to a flat 30 which provide a contact surface against which handle 18 engages handle 16. Tab 26 prevents handle 16 from slipping over handle 18 in use and reduces any chance for members 22 to undesirably snap off or escape from handle 18, which may ordinarily cause a dangerous condition for a user. FIG. 4 shows flexible members 22 in an extended state before engaging Surfaces 28 and 30 with handle 18.

Figure 5:
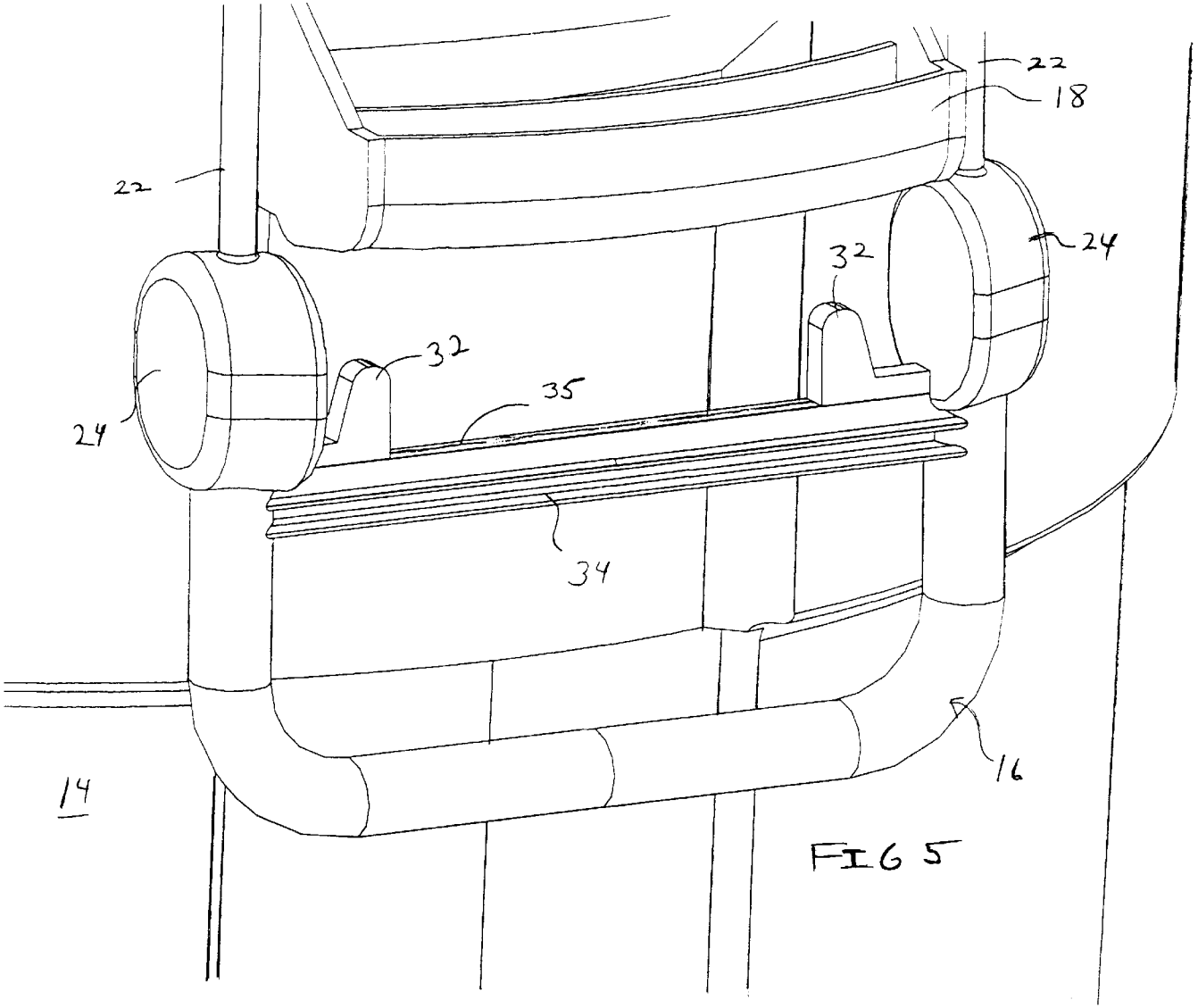
FIG. 5 is a perspective view showing the cover holder of FIGS. 2 and 4 having adjustable tabs for accommodating different sized container handles in accordance with another embodiment of the present invention.

Referring to FIG. 5, tabs 32 may be employed as a substitute for tab 26. The present invention contemplates a plurality of different tab configurations adapted to different handle configurations. Tabs 32 are mounted on a beam or other rigid member 34 to provide sufficient support for the retention of flexible members 22. Tabs 32 may be adjustable by riding on a track 35. In this way, a plurality of different sized handle configurations may be supported by handle 16.

Figure 6:
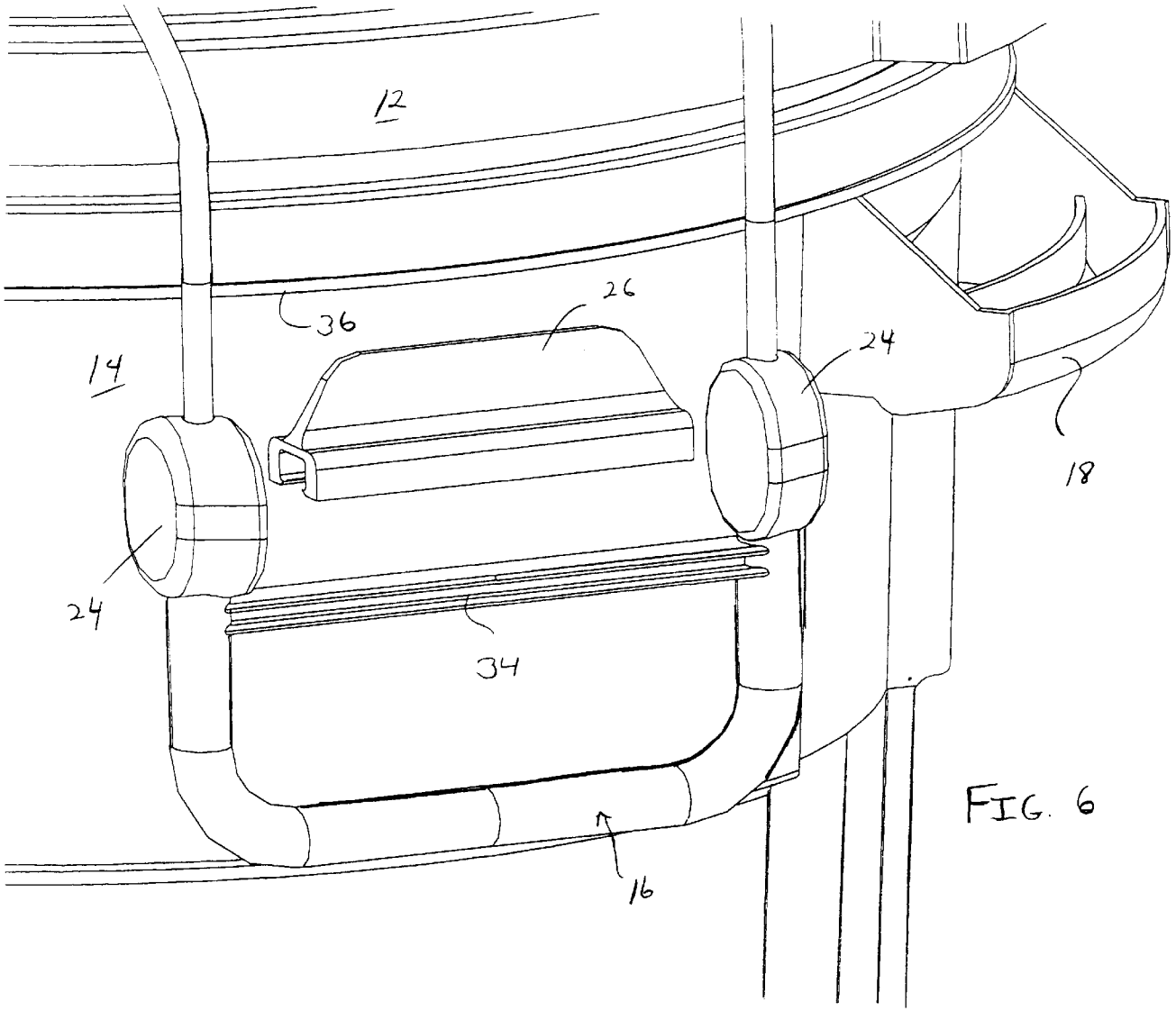
FIG. 6 is a perspective view showing the cover holder of FIG. 4 having a removable tab for accommodating different sized container handles and clipping onto different portion of the container in accordance with another embodiment of the present invention.

Referring to FIG. 6, in another embodiment, adjustability for different handle types may be achievable by making tab 26 removable as illustratively shown. Tab 26 may snap onto beam 34 or be attached by other means to beam 34, for example, by screws, clips, clasps or any other equivalent retaining devices. Tab 26 may also be employed using a rim 36 of container 14 instead of or in addition to a handle 18.

Figure 7:
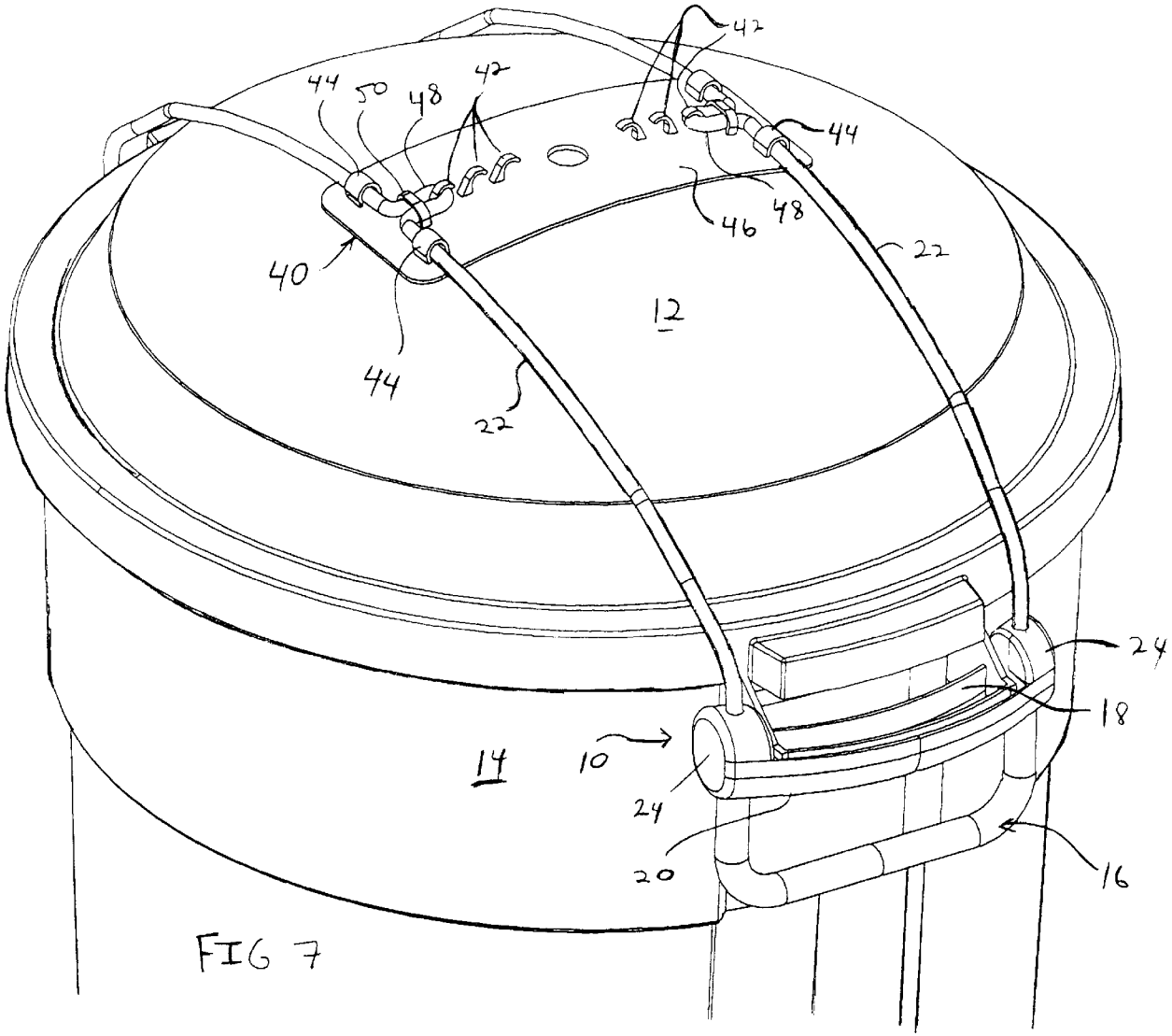
FIG. 7 is a perspective view showing the cover holder of FIG. 1 having an adjustment mechanism to adjust the tension in a flexible member in accordance with another embodiment of the present invention.

Referring to FIG. 7, an adjustment mechanism 40 is shown in accordance with another aspect of the present invention. Adjustment mechanism 40 includes hooks or retainers 42 configured and dimensioned to receive and hold flexible members 22. Flexible members 22 are threaded through eyes 44 or otherwise slidably coupled to a plate 46. Flexible members 22 may be configured to be secured by one or more retainers 42. In the embodiment shown in FIG. 7, flexible members 22 are threaded through an eye 50 attached to plate 46. A u-shaped portion 48 of members 22 is captured and secured by retainers 42. A user may move and secure portions 48 onto one of retainers 42 to provide increased or decreased tension in flexible members 22 to thereby provide adjustment to device 10 and/or variations thereof.

Figure 8:
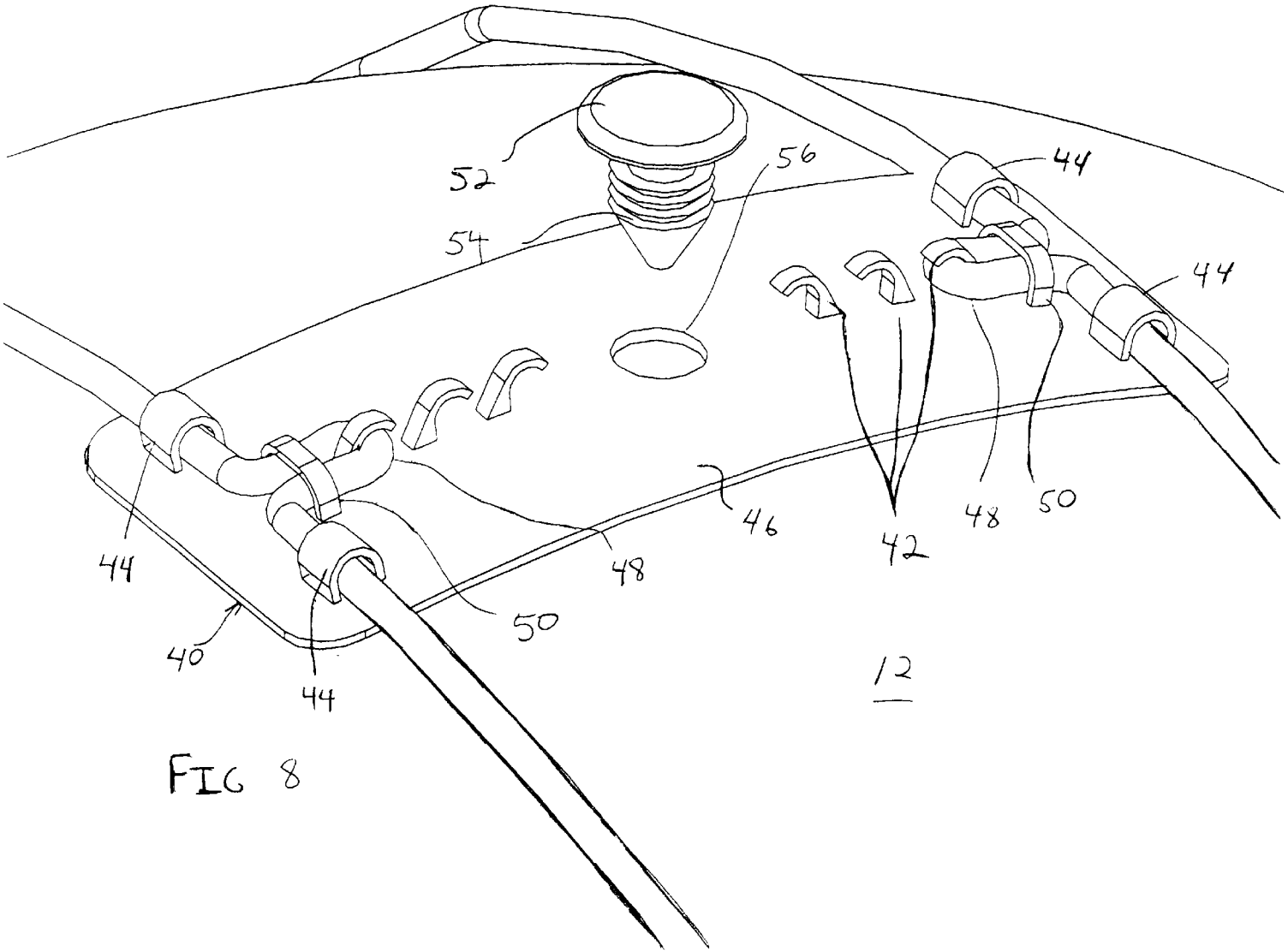
FIG. 8 is an exploded perspective view showing the adjustment mechanism of FIG. 7 being secured to a cover in accordance with another embodiment of the present invention.

Referring to FIG. 8, adjustment mechanism 40 may be secured to cover 12 by an attachment device 52. Attachment device 52 may include a rivet, screw, clip or any other mechanical connection device. Alternately, plate 46 may be glued or snapped into cover 12 to secure mechanism 40 in place. In the embodiment shown in FIG. 8, device 52 includes barbs 54, which pass through a hole 56 (clearance fit) and enter cover 12 through a hole therethrough (not shown) with an interference fit. When barbs 54 pass through plate 46 and into cover 12, device 40 is secured in place. Attachment device 52 may be capable of some axial movement, but provides attachment to cover 12 to prevent separation between cover 12 and device 40.

Figure 9:
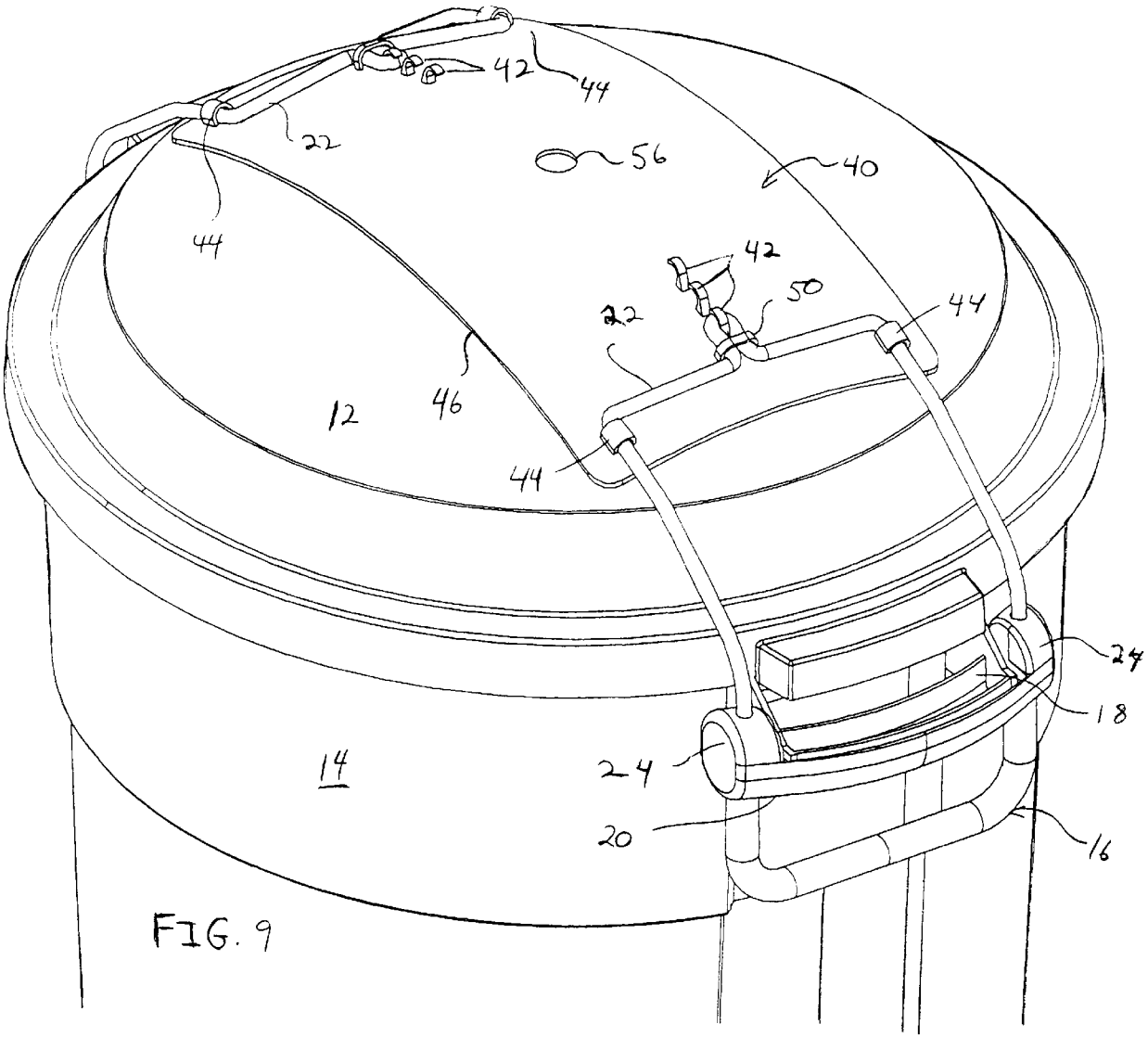
FIG. 9 is a perspective view showing an adjustment mechanism to adjust the tension in a flexible member having a different orientation and configuration in accordance with another embodiment of the present invention.
Figure 10:
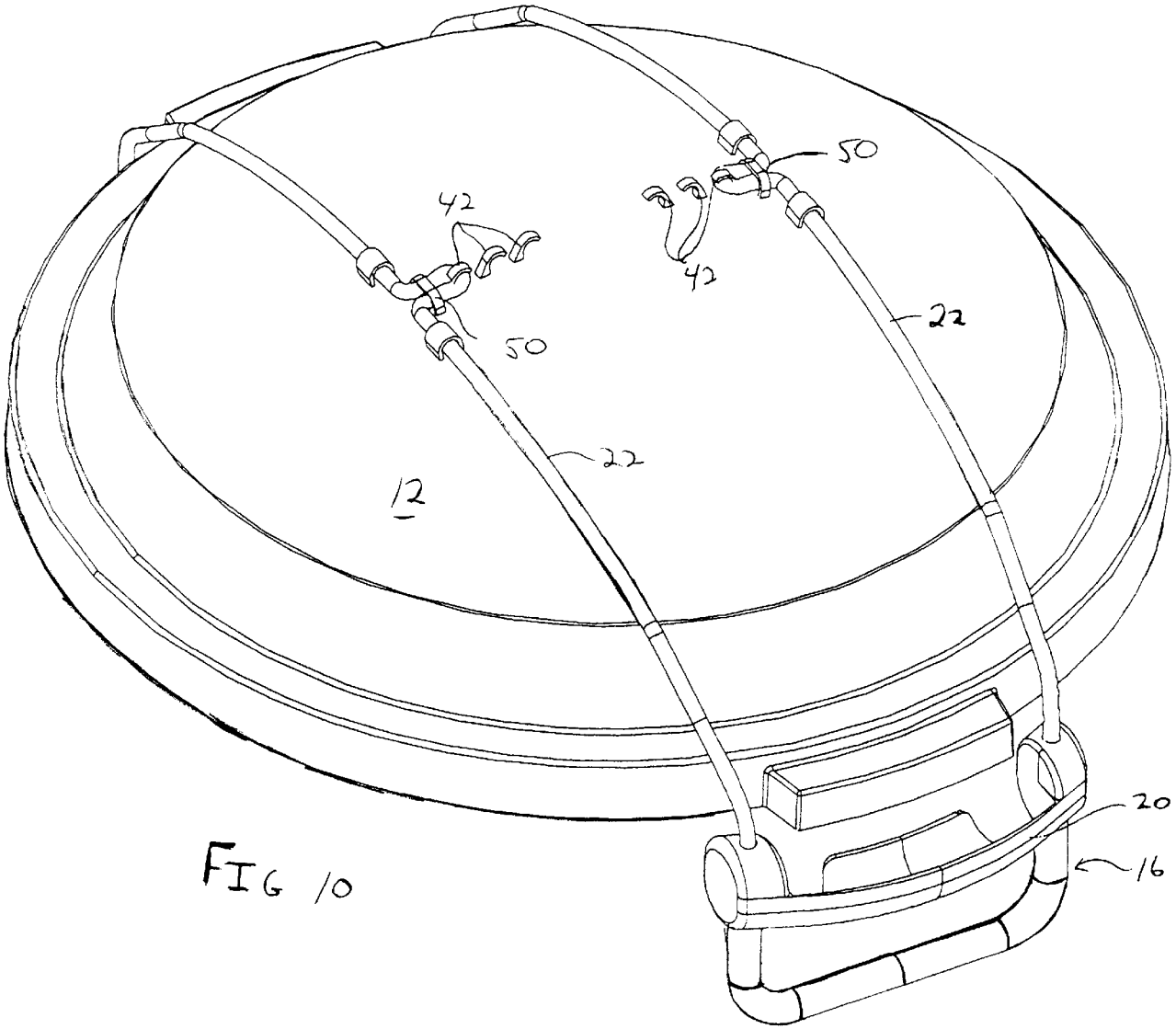
FIG. 10 is a perspective view showing the adjustment mechanism of FIG. 7 having positions/hooks mounted on a cover in accordance with another embodiment of the present invention.
Figure 11:
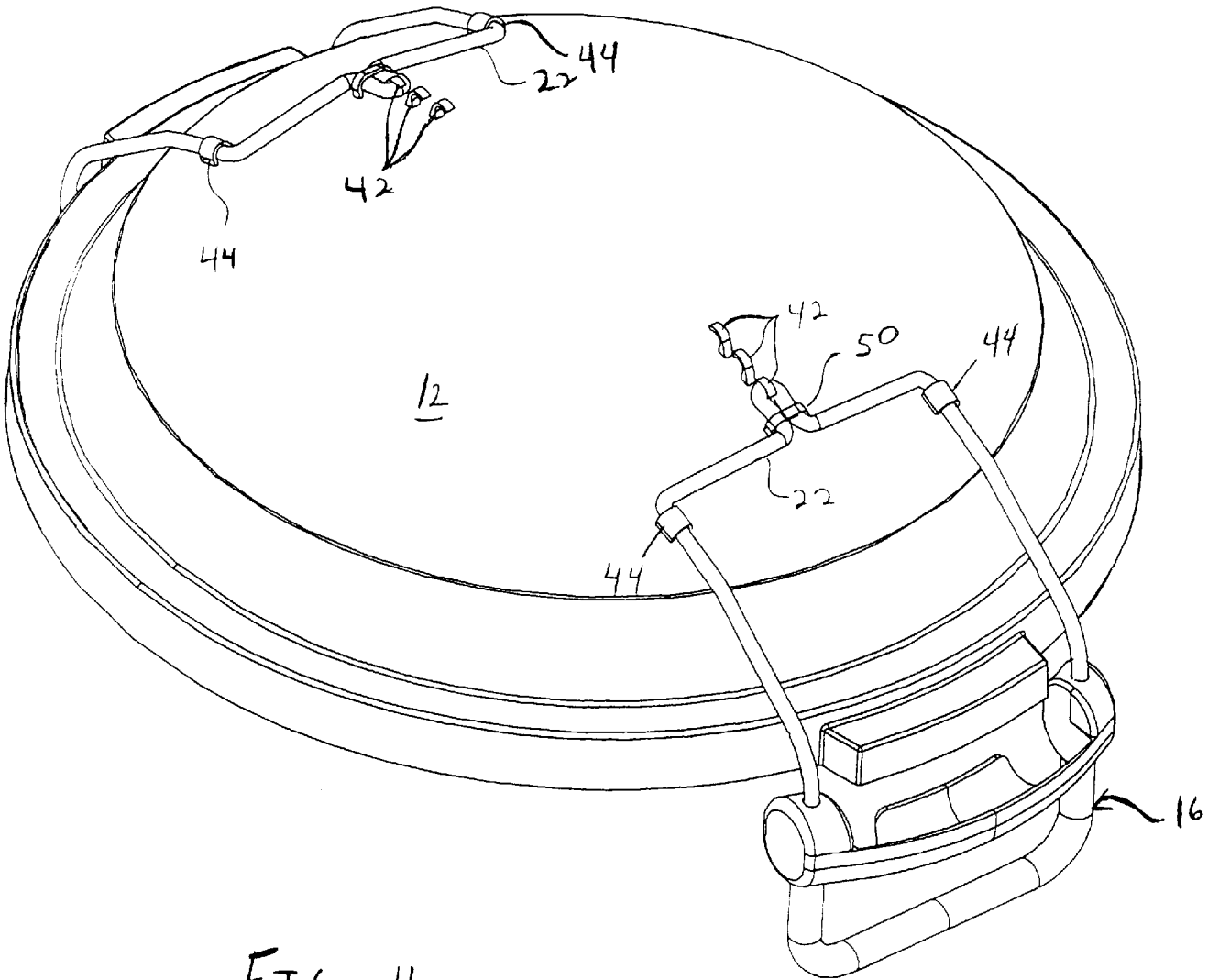
FIG. 11 is a perspective view showing the adjustment mechanism of FIG. 9 having positions/hooks mounted on a cover in accordance with another embodiment of the present invention.

Referring to FIG. 9, an alternate embodiment of device 40 includes a different orientation of retainers 42, and provides individual adjustment of each handle 16. A hole 56 or other device may be employed to attach plate 46 to cover 12. FIGS. 10 and 11 show retainers 42, eyes 44 and eyes 50 integrally formed or attached to covers 12 in accordance with another embodiment of the present invention.

Figure 12:
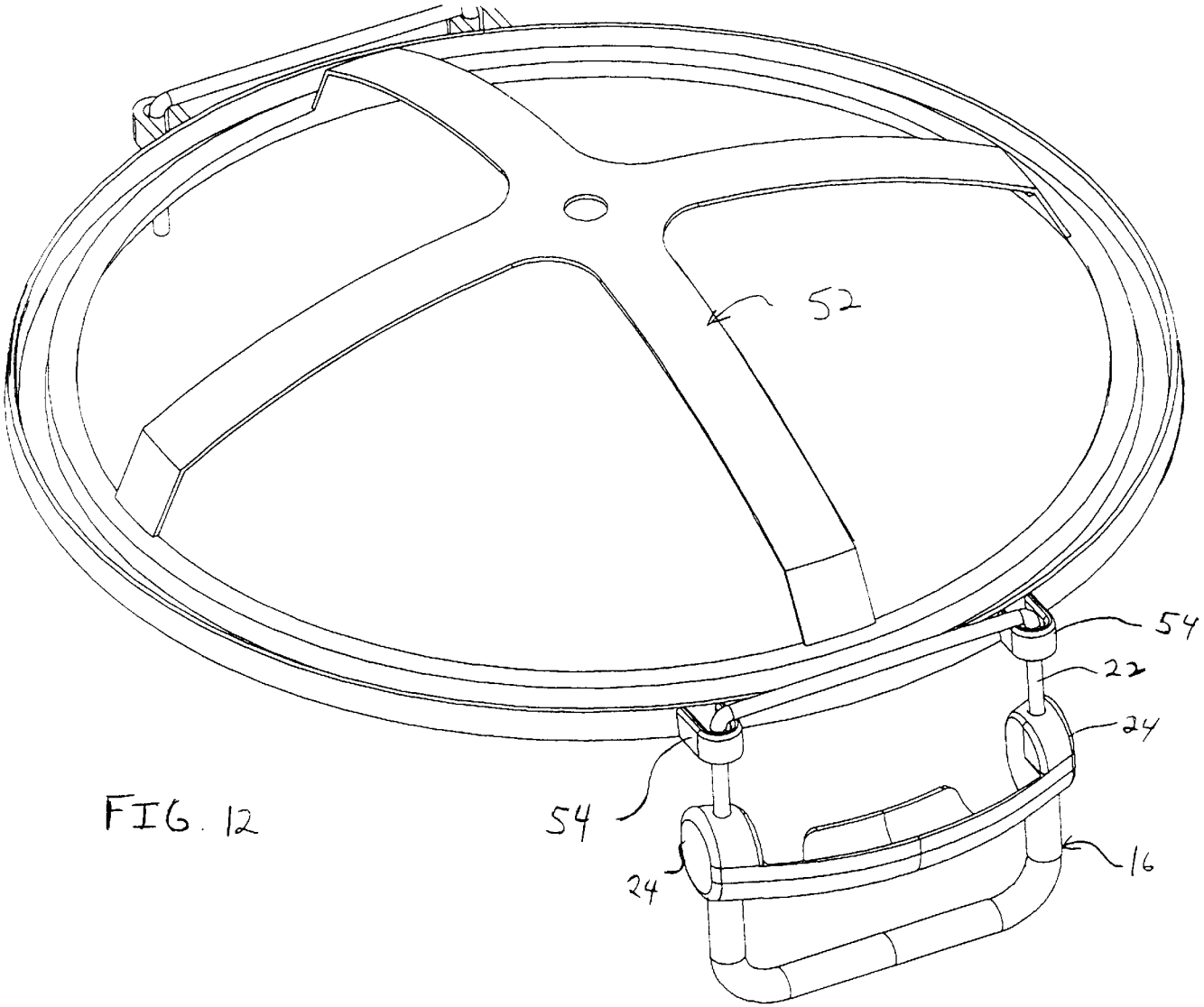
FIG. 12 is a perspective view showing a ring or guard having eye structures for securing flexible members in accordance with another embodiment of the present invention.
Figure 13:
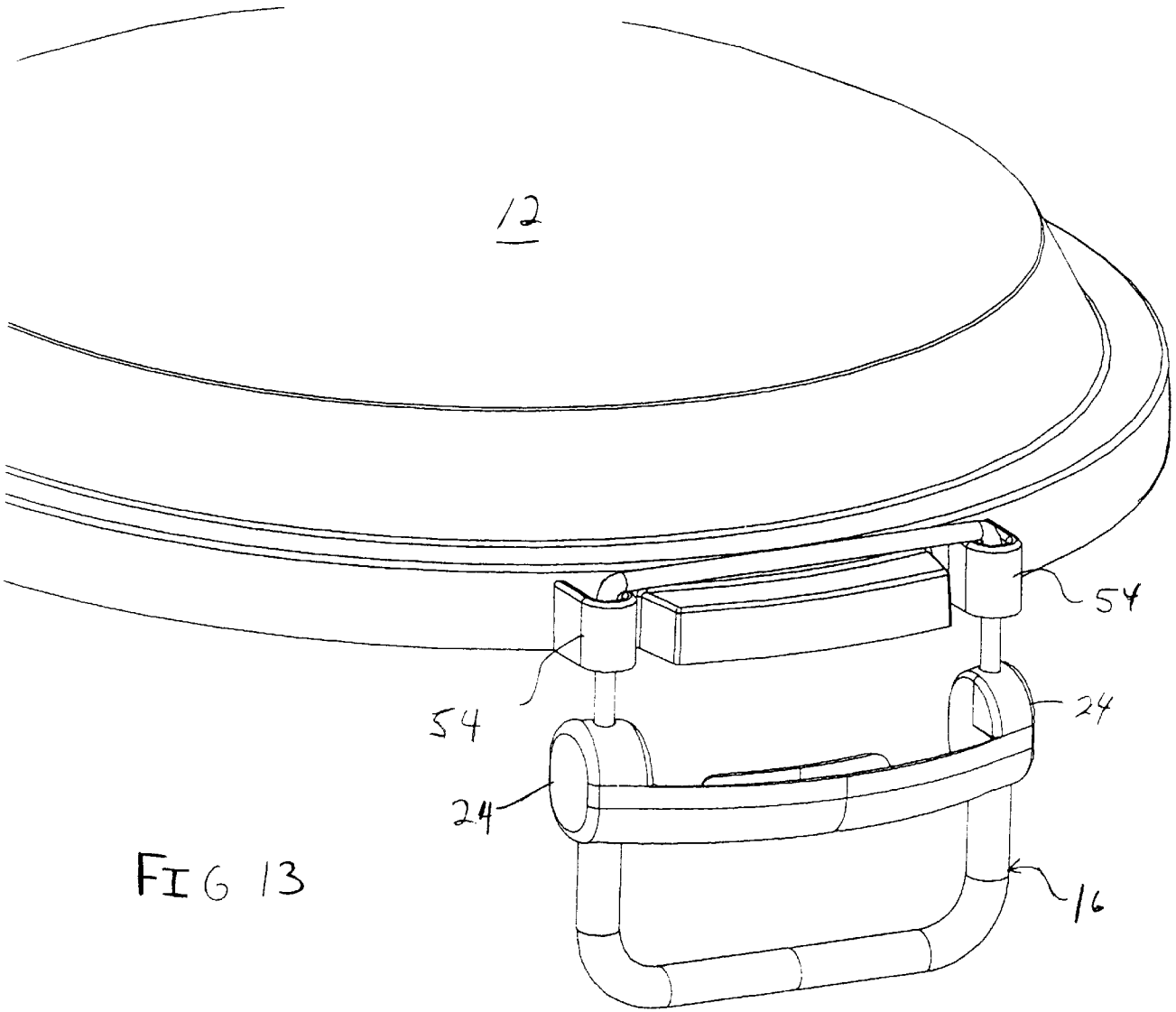
FIGS. 13–14 are perspective views showing eye structures formed in the cover for securing flexible members in accordance with the present invention.
Figure 14:
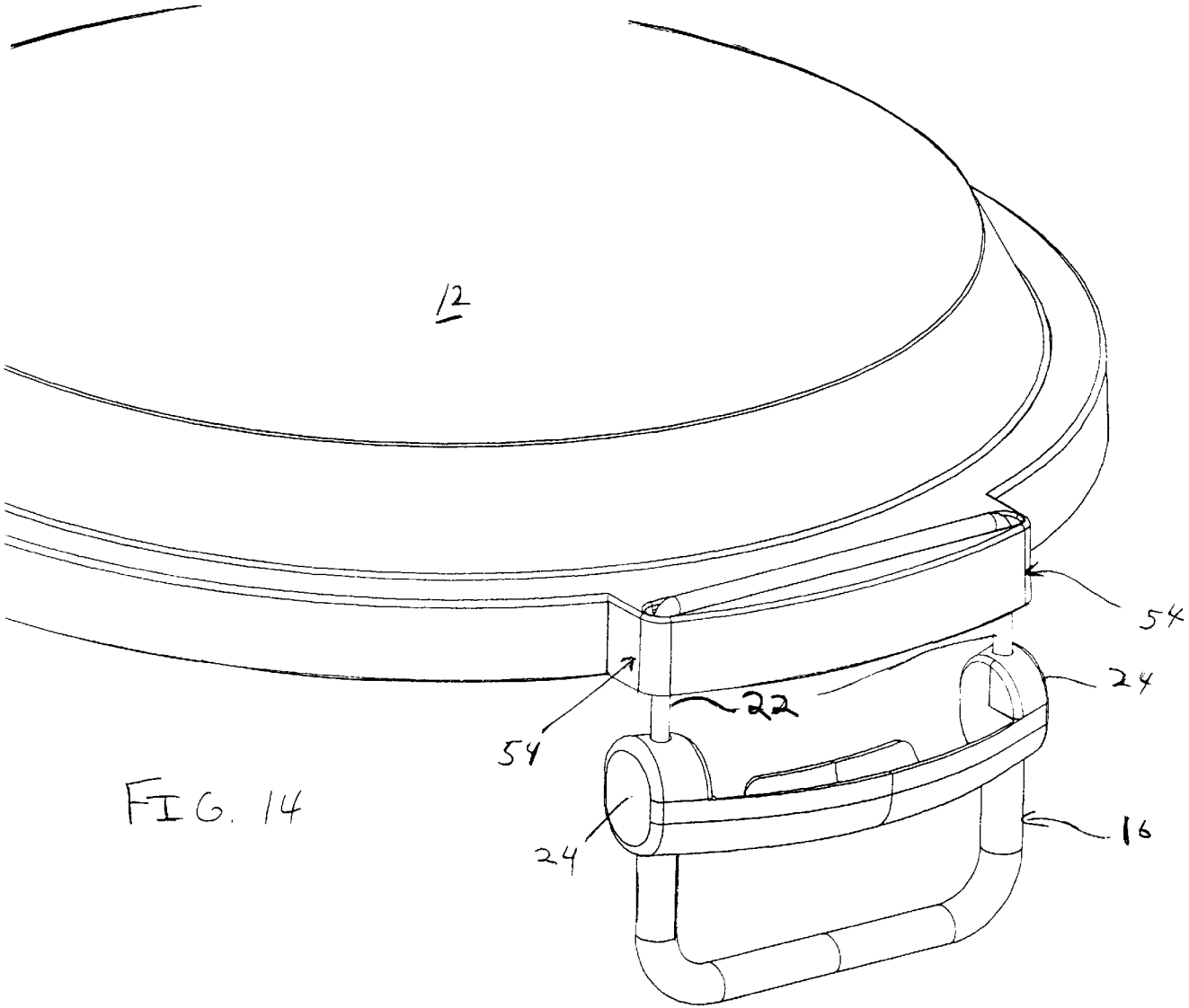

Referring to FIG. 12, a cover guard or ring 52 may be configured and dimensioned to fit over a cover 12. Guard 52 may include eyes 54 to receive and secure flexible members 22. Referring to FIGS. 13 and 14, cover 12 may be provided with eyes 54 integrally formed therein. In this way, the use of an additional part, namely a guard 52 may be avoided.

Figure 15:
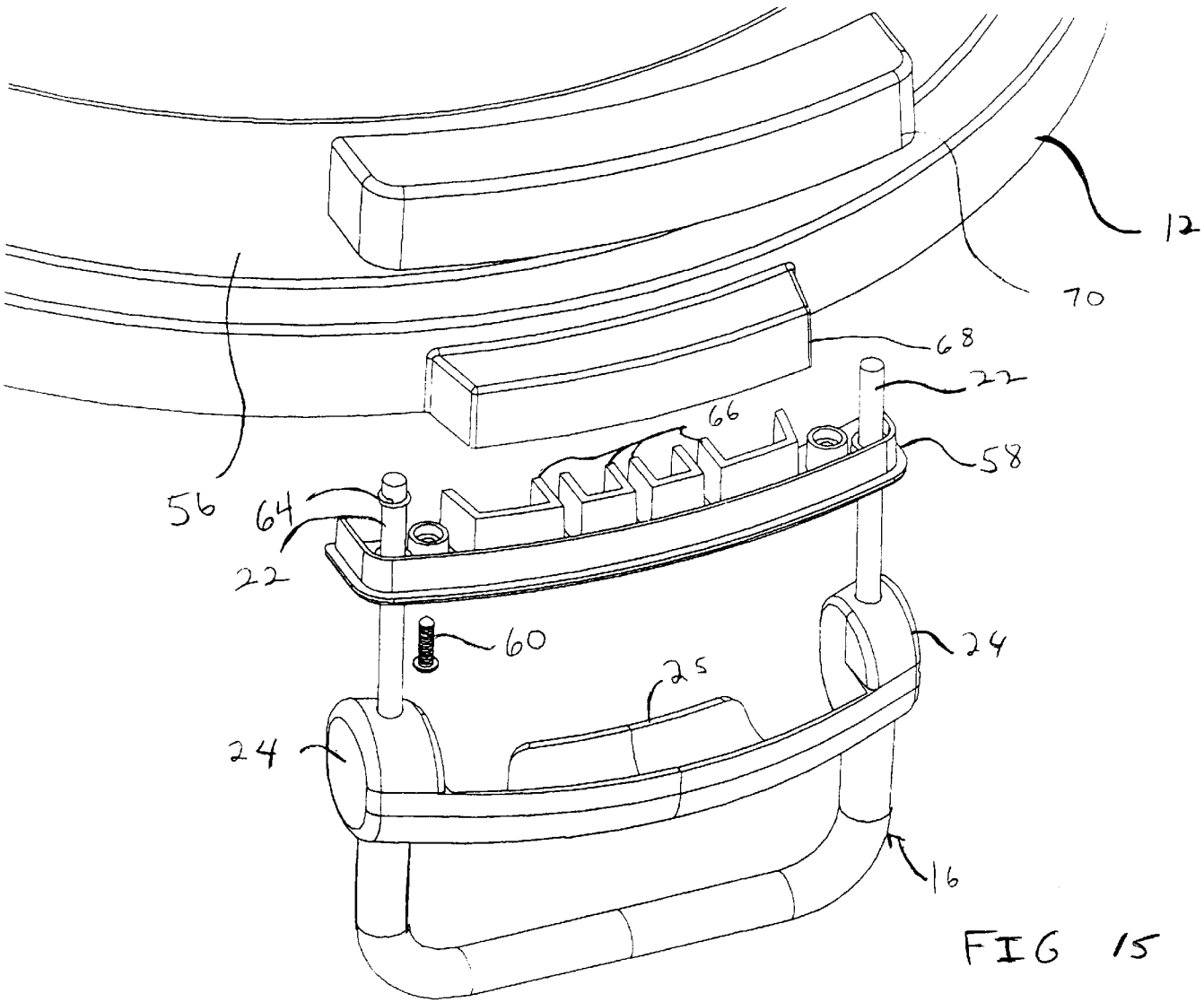
FIGS. 15–17 are perspective views showing a guard and a platform for fitting over a portion of the cover for securing the cover to the container in accordance with the present invention.
Figure 16:
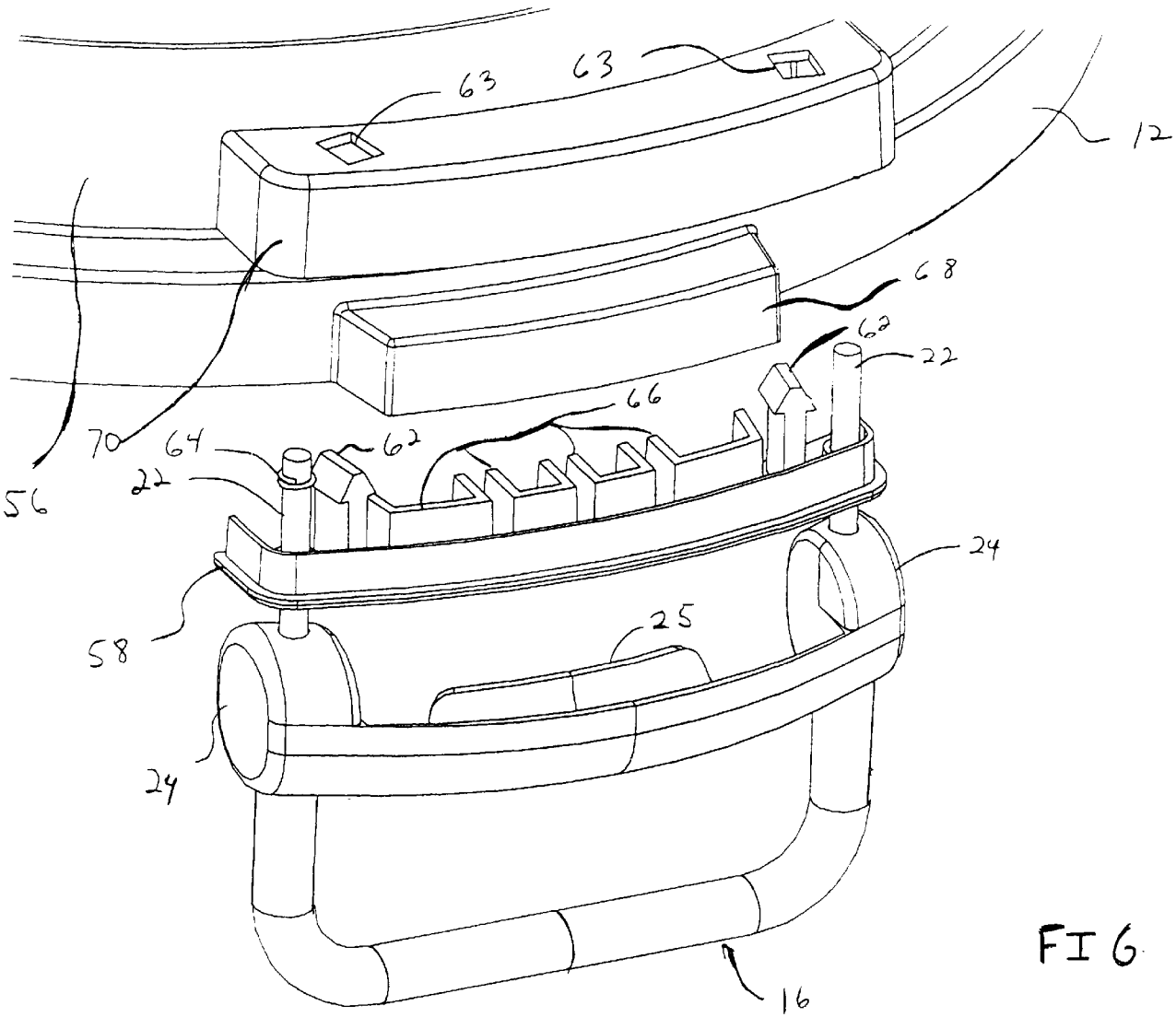

Referring to FIGS. 15 and 16, a cover guard or ring 56 may be provided and adapted to receive a platform 58. Platform 58 may be secured to guard or ring 56 by screws 60, snaps, rivets or other types of fastening mechanisms 62. Alternately, a boot portion 70 may be used independently of guard or ring 56 and provided to sandwich a cover handle 68 between platform 58 and boot portion. FIG. 16 shows barbed fasteners 62 which are received into holes 63 and secured by snapping the barbed fasteners 62 into holes 63. Flexible members 22 are terminated, with a snap ring 64, a pin (not shown) or any other type of termination mechanism, in platform 58 to prevent pullout when handle 16 is extended over the handle 18 of container 14. Structures 66 may be provided to increase the rigidity of platform 58, and to receive cover handle 68, which is integrally formed in cover 12.

Figure 17:
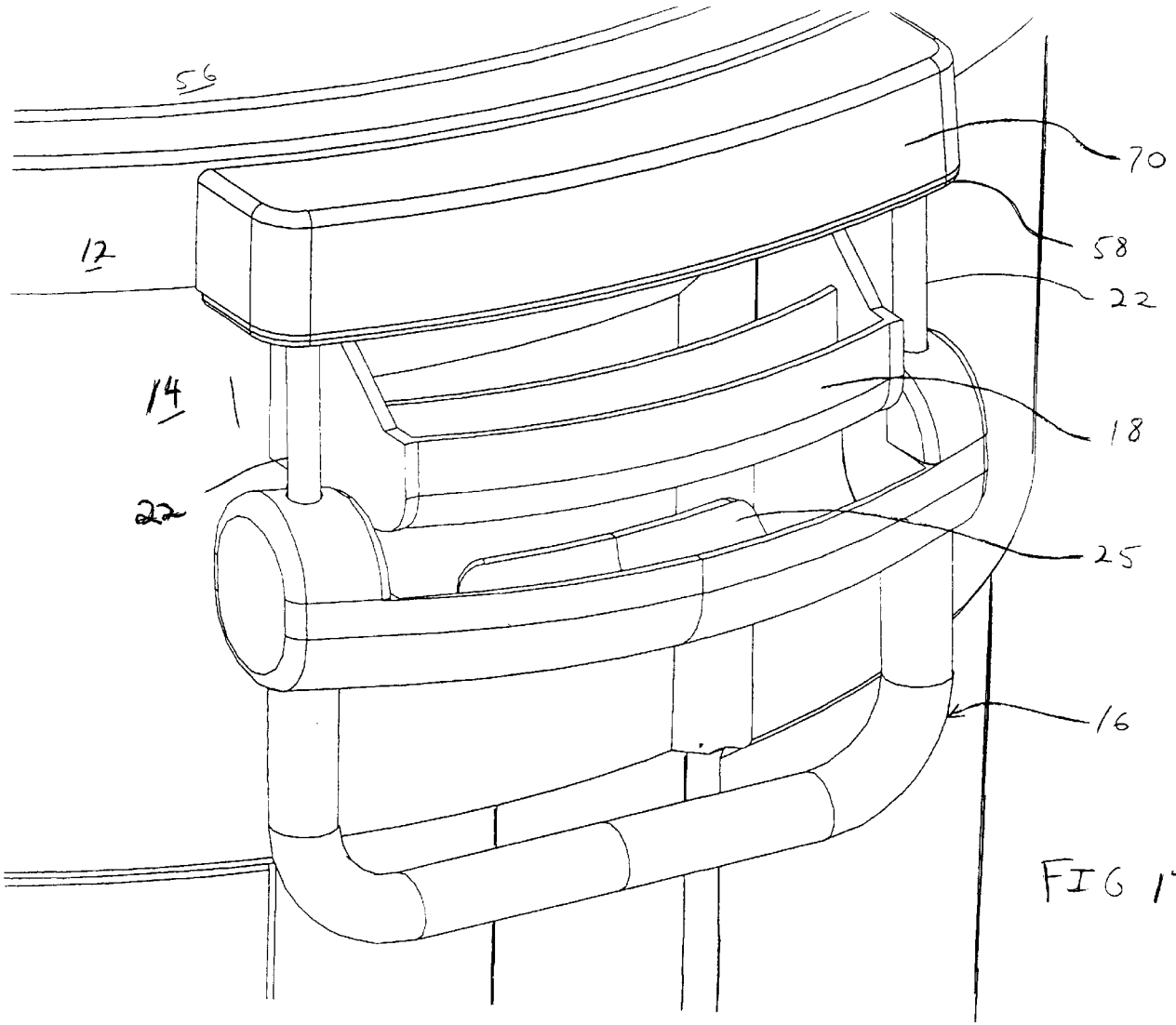

Referring to FIG. 17, a completed assembly of the illustrative embodiments shown in FIGS. 15 and 16 is shown while handle 16 is being extended over handle 18 to secure cover in place. Cover handle 68 is encapsulated between portion 70 (which may be part of ring or guard 56 or simply include a separate boot portion 70) and platform 58. In this way, cover 12 and cover guard 56 are attached, and the cover securing assembly is mounted on and adapted for use with an existing container 14 and cover 12 system.

Figure 18:
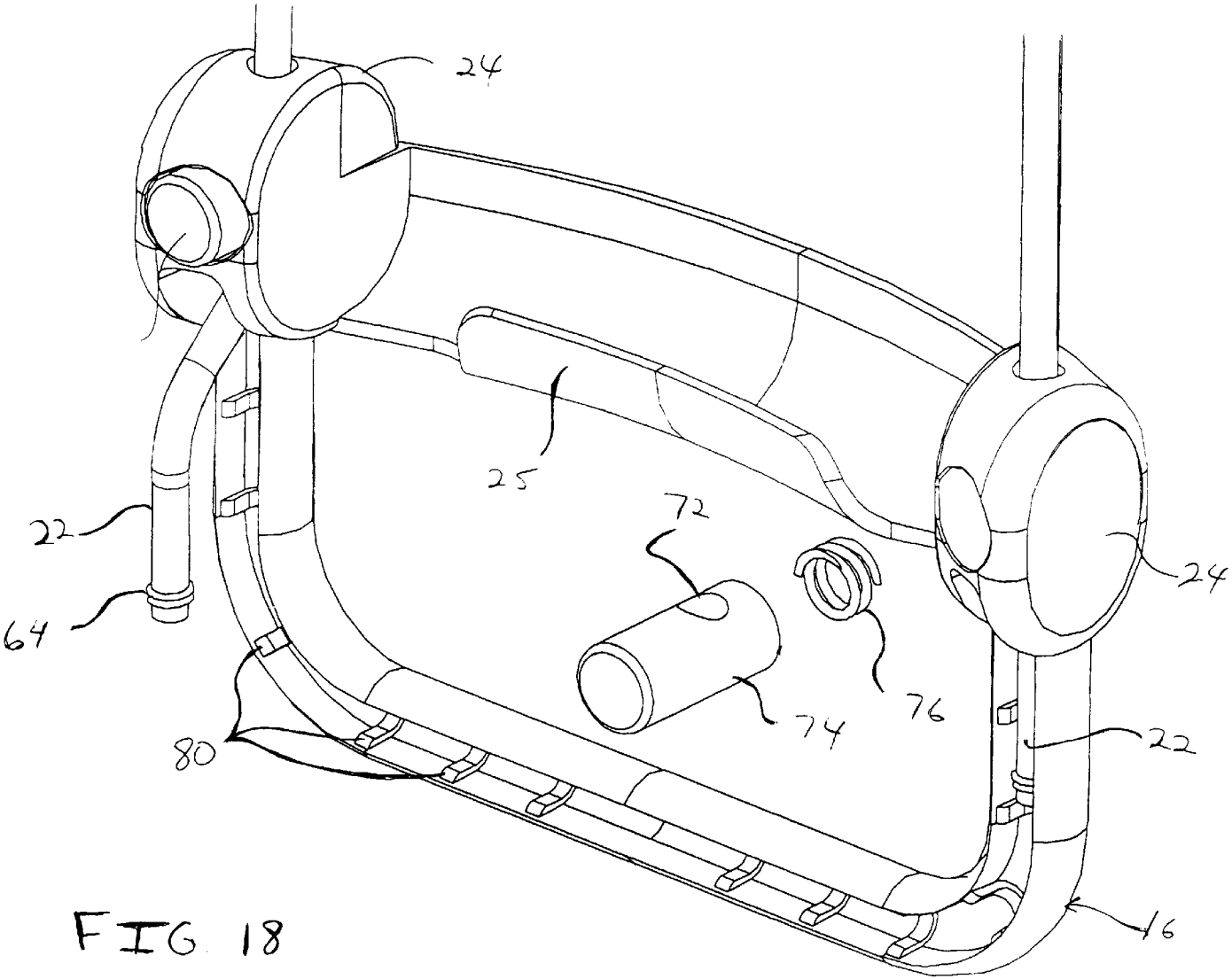
FIGS. 18–20 are perspective views showing tensioning and securing devices for flexible members to secure the cover to the container in accordance with the present invention.

Referring to FIG. 18, anchor portions 24 may permit slidable adjustment of flexible members 22. Flexible members 22 are threaded through anchor portions 24 and through a hole 72 formed through a securing member 74. Securing member 74 is biased by a biasing device 76, such as a spring. Securing member 74 displaces flexible member 22 relative to holes in anchor portion to secure flexible member 22 within anchor portion 24. When adjustment of flexible member 22 is needed, securing member 74 is depressed to align the holes of anchor portion with hole 72 to permit flexible member 22 to be pulled through to tighten flexible member 22. Securing member 74 is then released to resecure flexible member 22. Flexible member 22 may be terminated with snap rings 64, a pin (not shown) or the flexible member may be looped through handle 16 and back through the anchor portion 24 on the other side of the handle (not shown).

Figure 19:
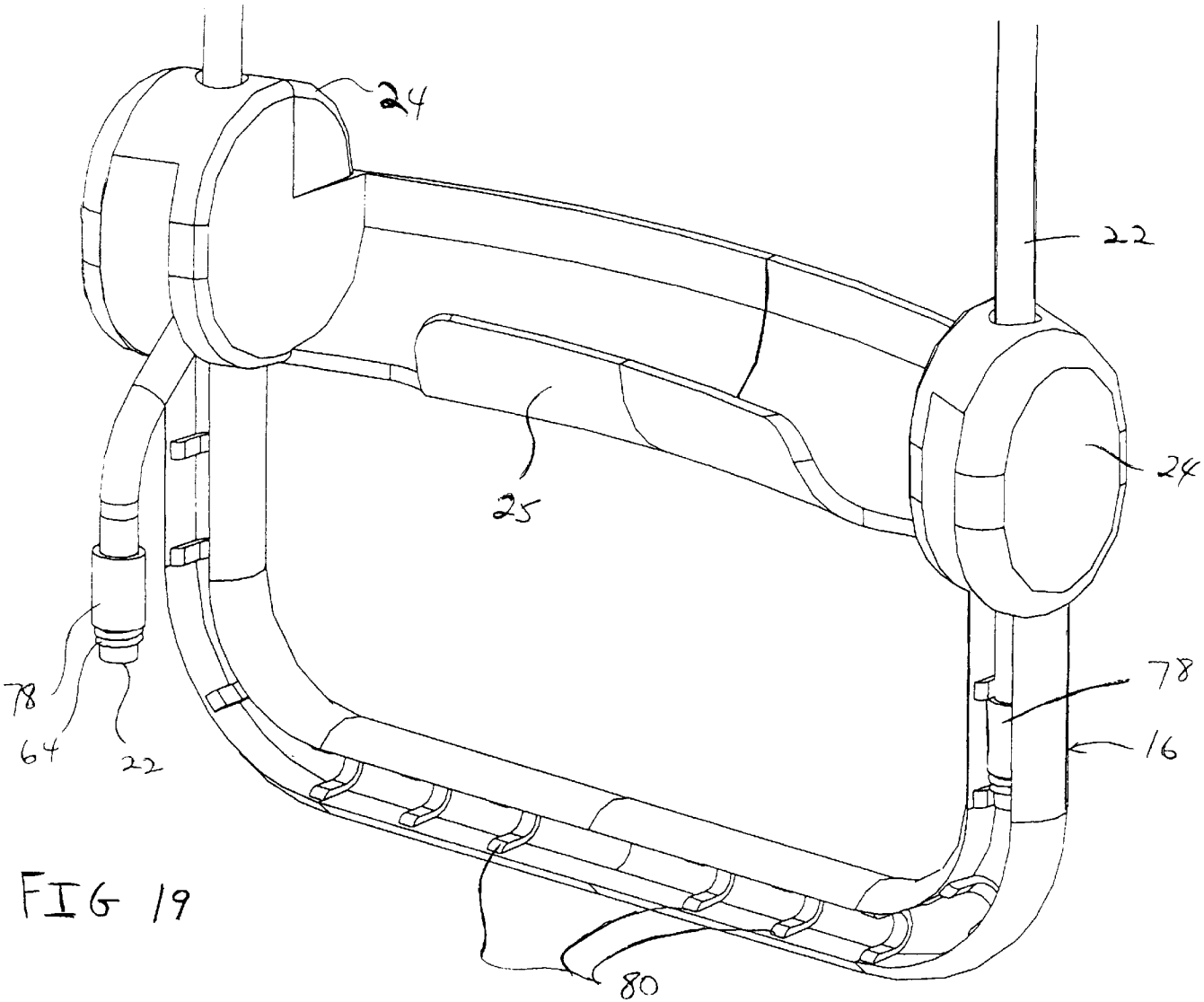
Figure 20:
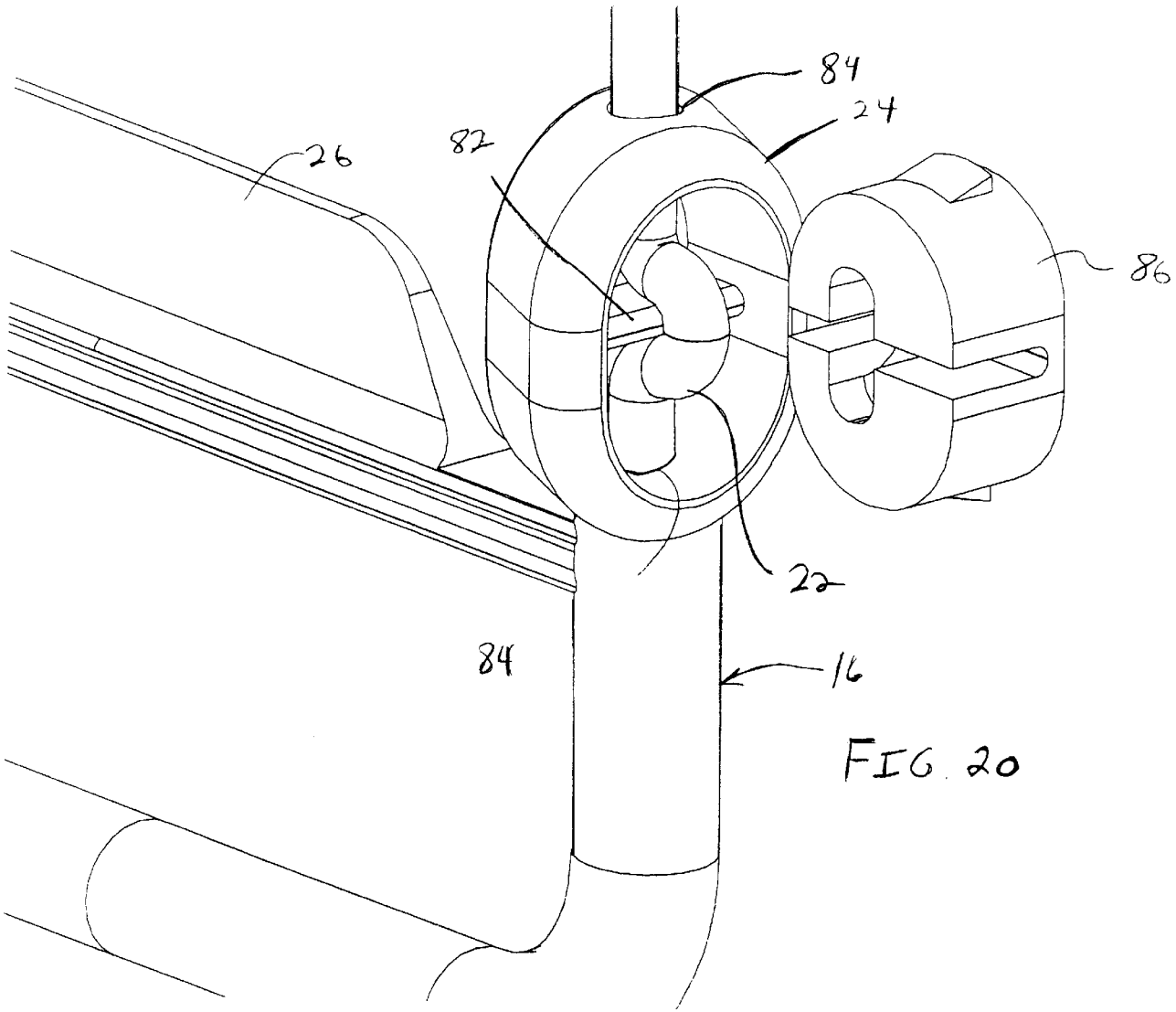

Referring to FIG. 19, a sleeve 78 may be employed which fits between ribs 80 formed within handle 16. In this way, flexible member 22 may be pulled through anchor portions 24 and secured in handle 16 in between ribs 80. Other mechanisms for adjusting and securing flexible members 22 may also be employed. For example, as shown in FIG. 20, flexible member 22 may be wrapped around a dowel 82 between holes 84 in anchor portion 24. Once adjusted to the appropriate length or tension, flexible member 22 is secured by installing a removable cap 86, which holds flexible member 22 in place.

Figure 21:
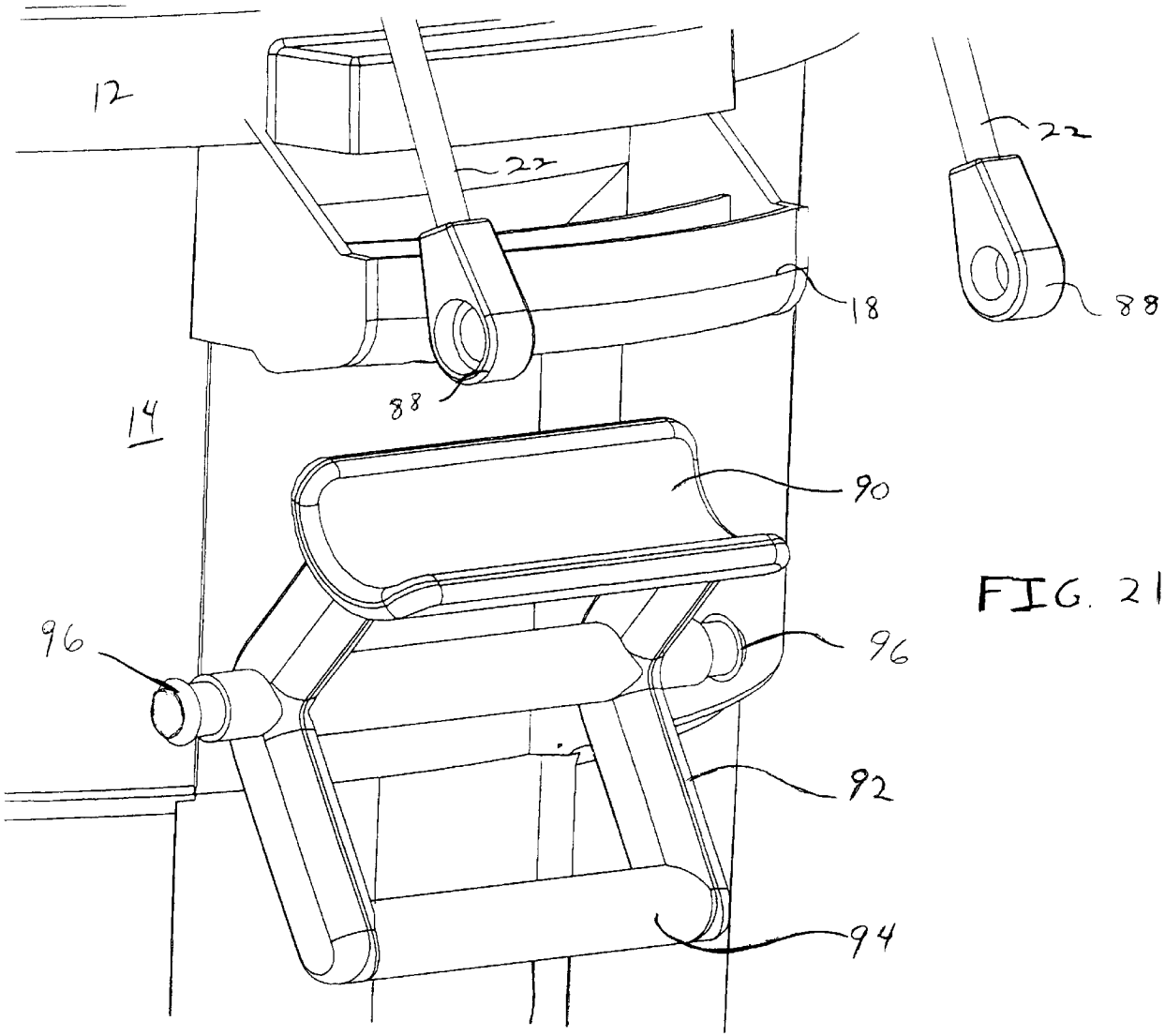
FIGS. 21–24 are perspective views showing lever-action cover holders in accordance with the present invention.
Figure 22:
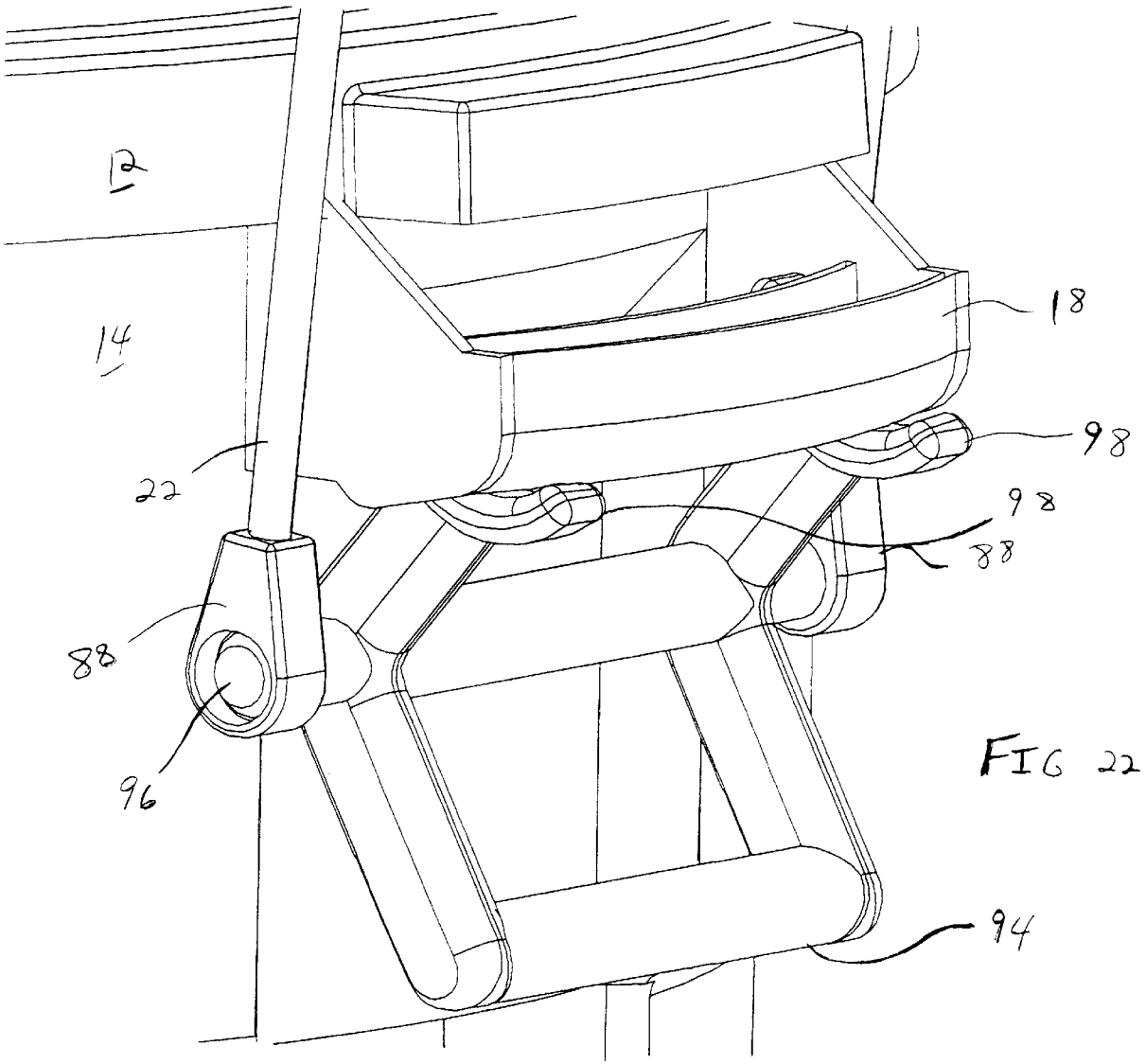
Figure 23:
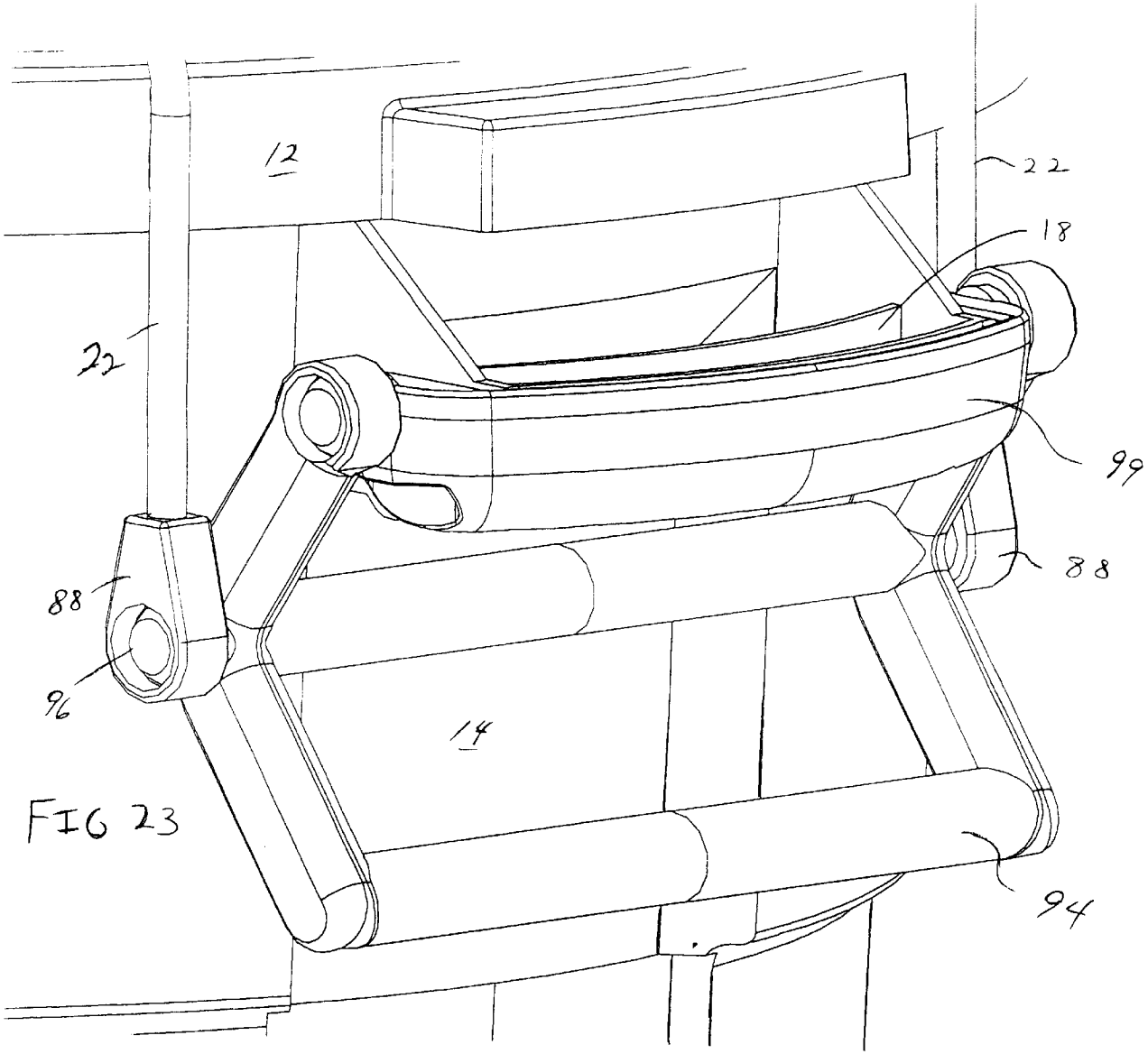

Referring to FIG. 21, flexible members 22 are shown with a termination 88 having a hole 89 adapted to receive a rod 96 to provide a pivot motion between flexible member 22 and a locking handle 94. FIG. 21 shows terminations 88 detached from axel 96 for clarity. Rod 96 and handle 94 may be integrally formed. An engagement surface 90 on handle 94 is provided to apply pressure against handle 18 when a pivot connection is made between rod 96 and termination 88. In one embodiment, termination 88 snaps onto rod 96 to provide the pivot connection. To engage handle 94, surface 90 is contacted by handle 18 and rod 96 and terminations 88 are rotated below handle 18 to secure cover 12 to container 14. FIGS. 22 and 23 show different configurations of the embodiment shown in FIG. 21. Surface 90 is respectively replaced with members 98 or a cradle 99. FIGS. 22 and 23 show terminations 88 coupled to rod 96 in an engaged position.

Figure 24:
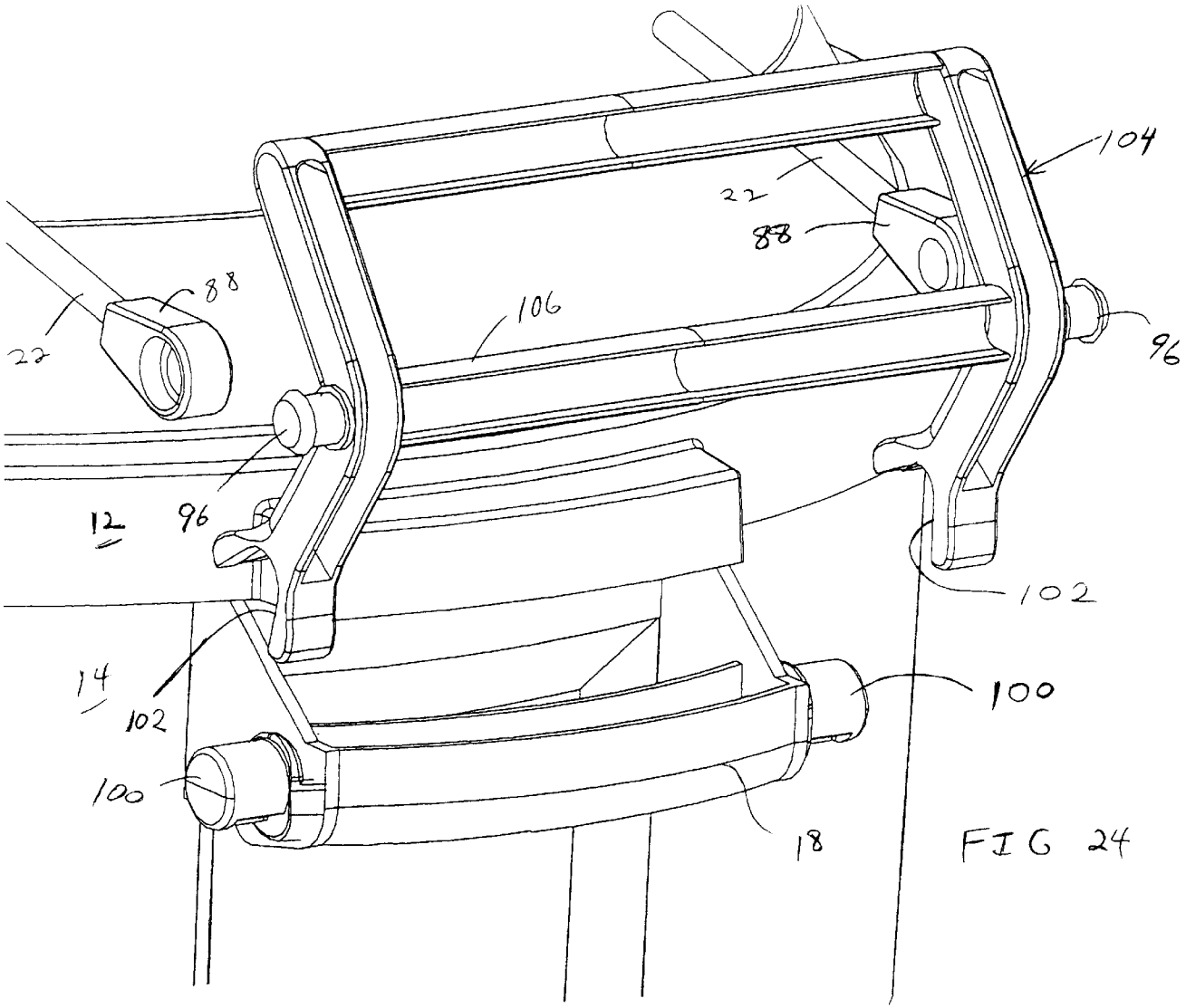

Referring to FIG. 24, another configuration includes handle 18 having rods or cylinders 100 attached thereto or formed therewith. An opened end member 102 engages cylinders 100 to provide a pivoting motion for a handle 104. Handle 104 includes rods 96 which snap or otherwise pivotally connect to terminations 88. Handle 104 is rotated down to secure a portion 106 below handle 18 to secure cover 12 on container 14.

Figure 25:
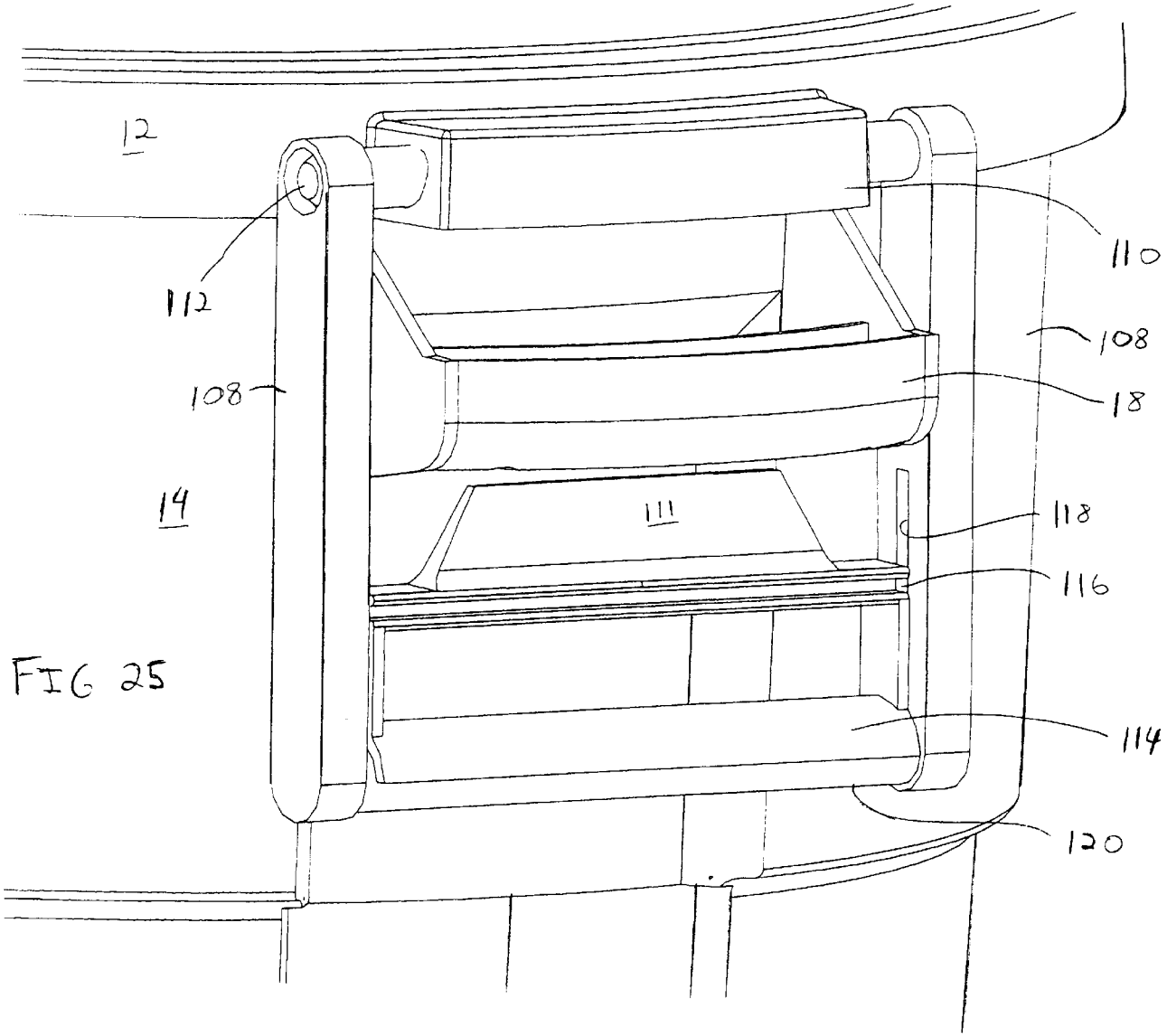
FIGS. 25–29 are perspective views showing biased pivot arm cover holders in accordance with the present invention.
Figure 26:
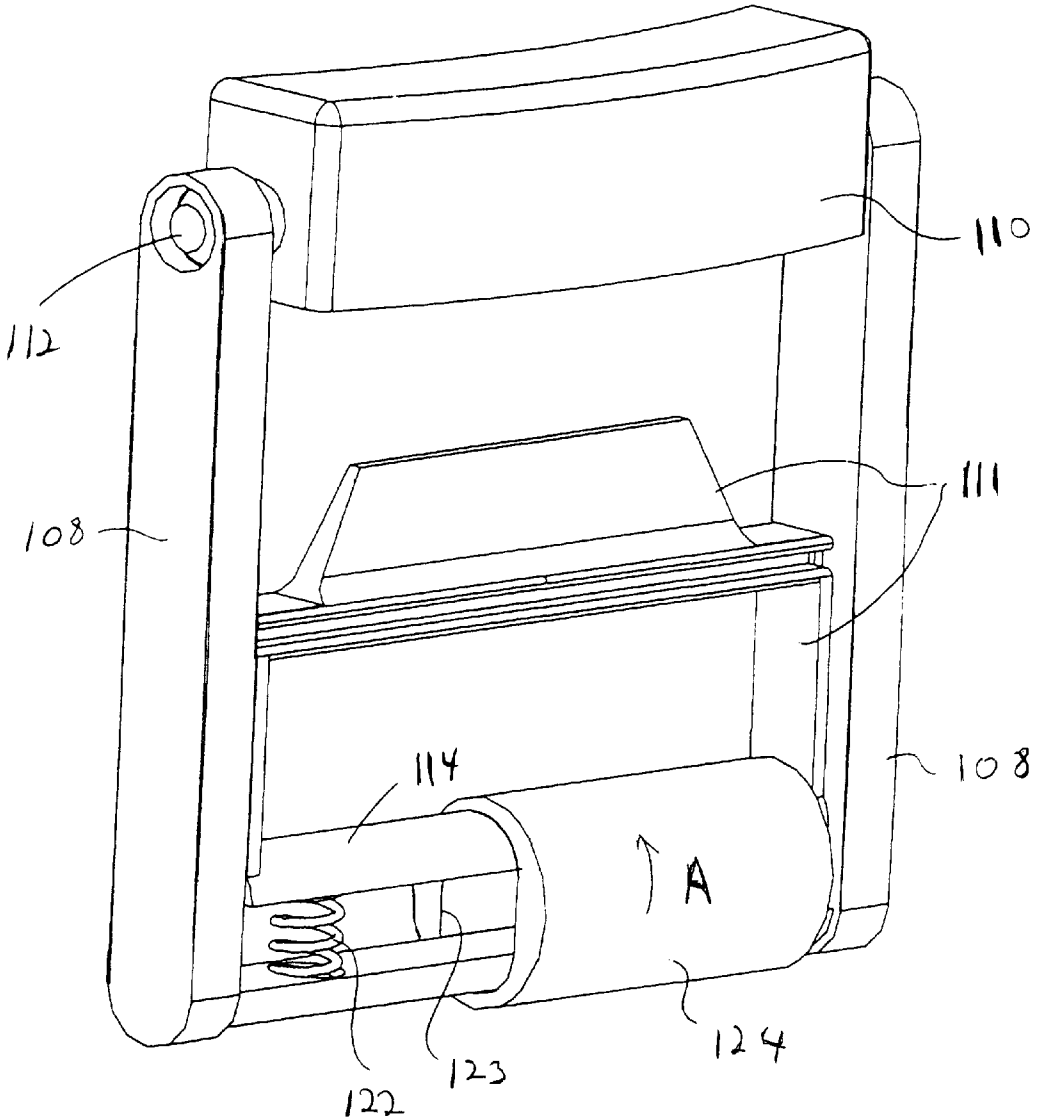
Figure 27:
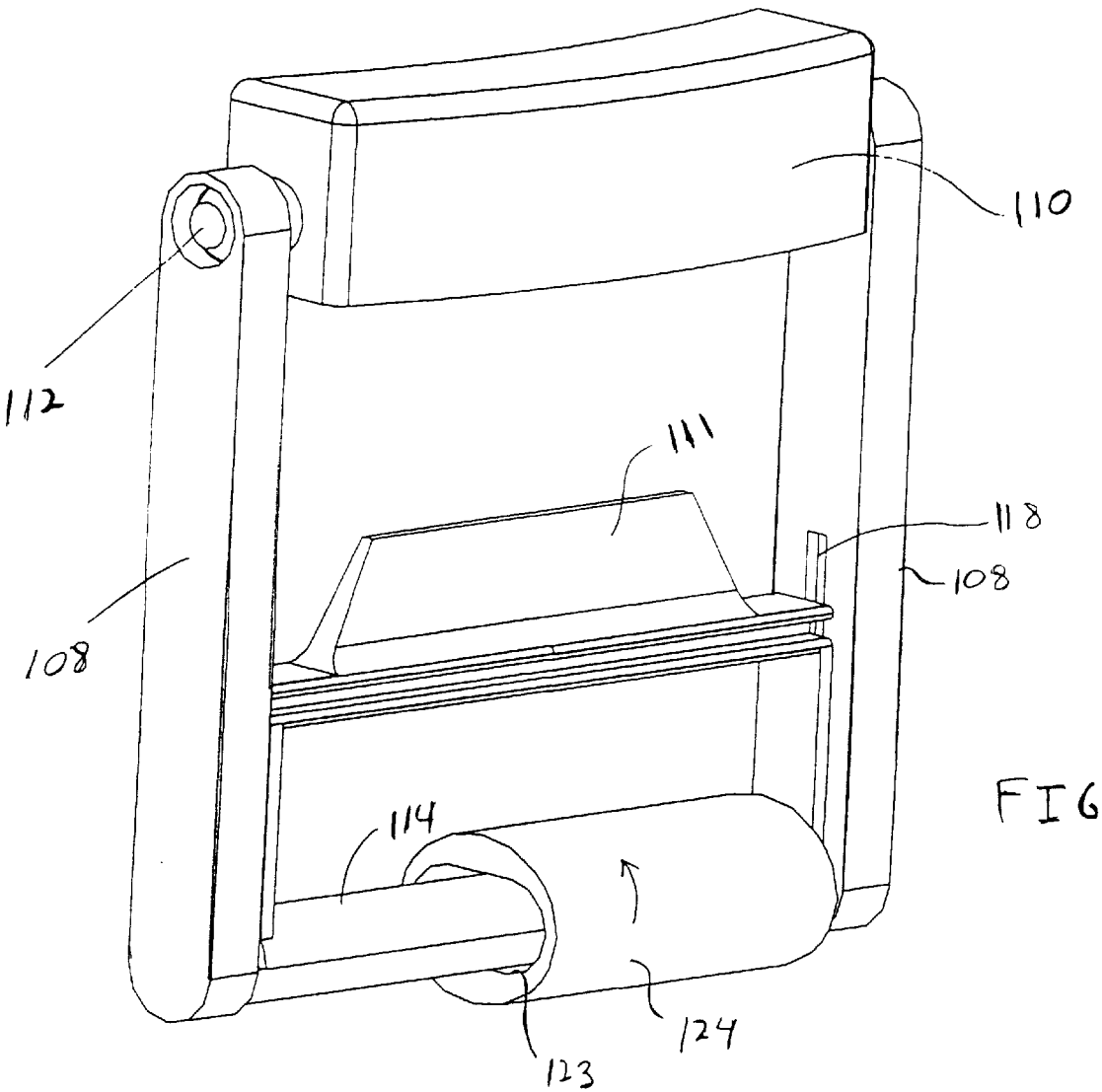

Referring to FIG. 25, cover 12 includes a cover handle 110 having rods 112 extending therefrom. Rods 112 and pivot arms 108 form a pivot joint for a handle 120. Pivot arms 108 include forms a channel or groove 118 to restrain lateral motion of a locking bar 111. Locking bar 111 includes tabs 116, which fit within grooves 118 to restrain the motion of locking bar 111 within grooves 118. Locking bar 111 is shown in FIG. 25 in a retracted position. FIG. 26 shows locking bar 111 in an advanced position (handle 18 is not shown for clarity). Locking bar 111 is biased by, for example, springs 122 to advance locking bar 111 so that locking bar 111 engages handle 18 (FIG. 25) to secure cover 12 (FIG. 25) on container 14. A rotating lock 124 may be employed to advance or retract locking bar 111. Lock 124 includes an oblong shaped cross-section inner contact surface 123, which engages portion 114 of bar 111. When lock 124 is rotated in the direction of arrow "A: springs 122 are compressed and locking bar 111 is retracted (FIG. 27). When rotated an additional 90 degrees, locking bar 111 is advanced to secure locking bar 111 in handle 18 (FIG. 26) and secure cover 12.

Locking bar 111 may be adapted for use at the rim of the container instead of the handle of the container. Locking bar 111 may be employed in combination with other features described herein.

Figure 28:
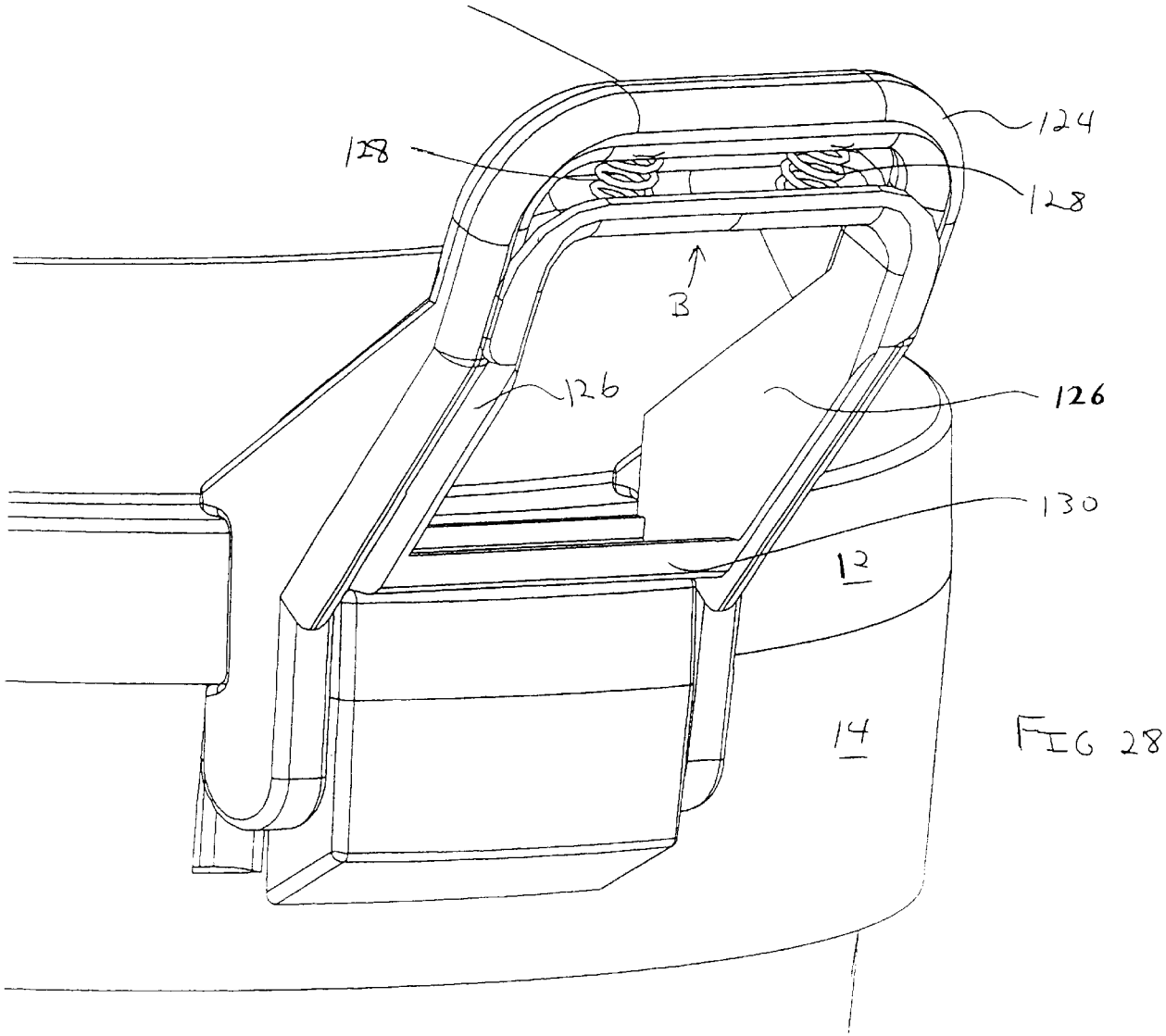
Figure 29:
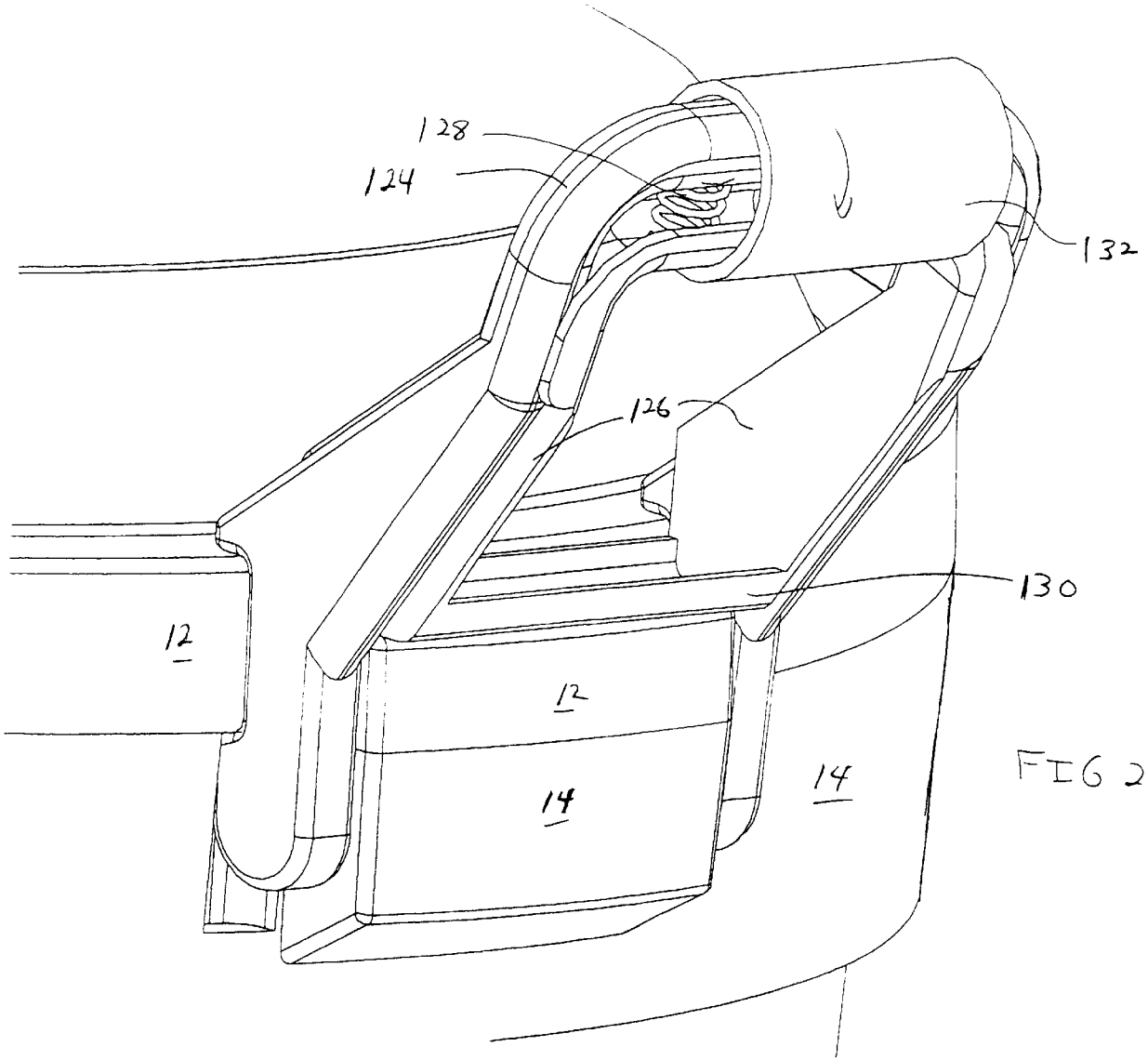

Referring to FIGS. 28 and 29, a pivoting handle 124 is pivotally connected to container 14. A retractable portion 126 is configured to fit within handle 124. Retractable portion 126 is dimensioned to engage cover 12 and is biased by springs 128 against cover 12 to secure cover 12 against container 14. To release handle 124, retractable portion 126 is displaced in the direction of arrow "B" and handle 124 is rotated downward to disengage an engagement portion 130 from cover 12 to permit cover 12 to be removed from container 14. Portion 126 may be locked by rotating lock 132 in the direction of arrow "C" (portion 126 is shown in the locked position). Portion 126 may be released by rotating lock 132 an addition 90 degrees from the position shown and then rotating handle 124 downward to release cover 12 from container 14.

Figure 30:
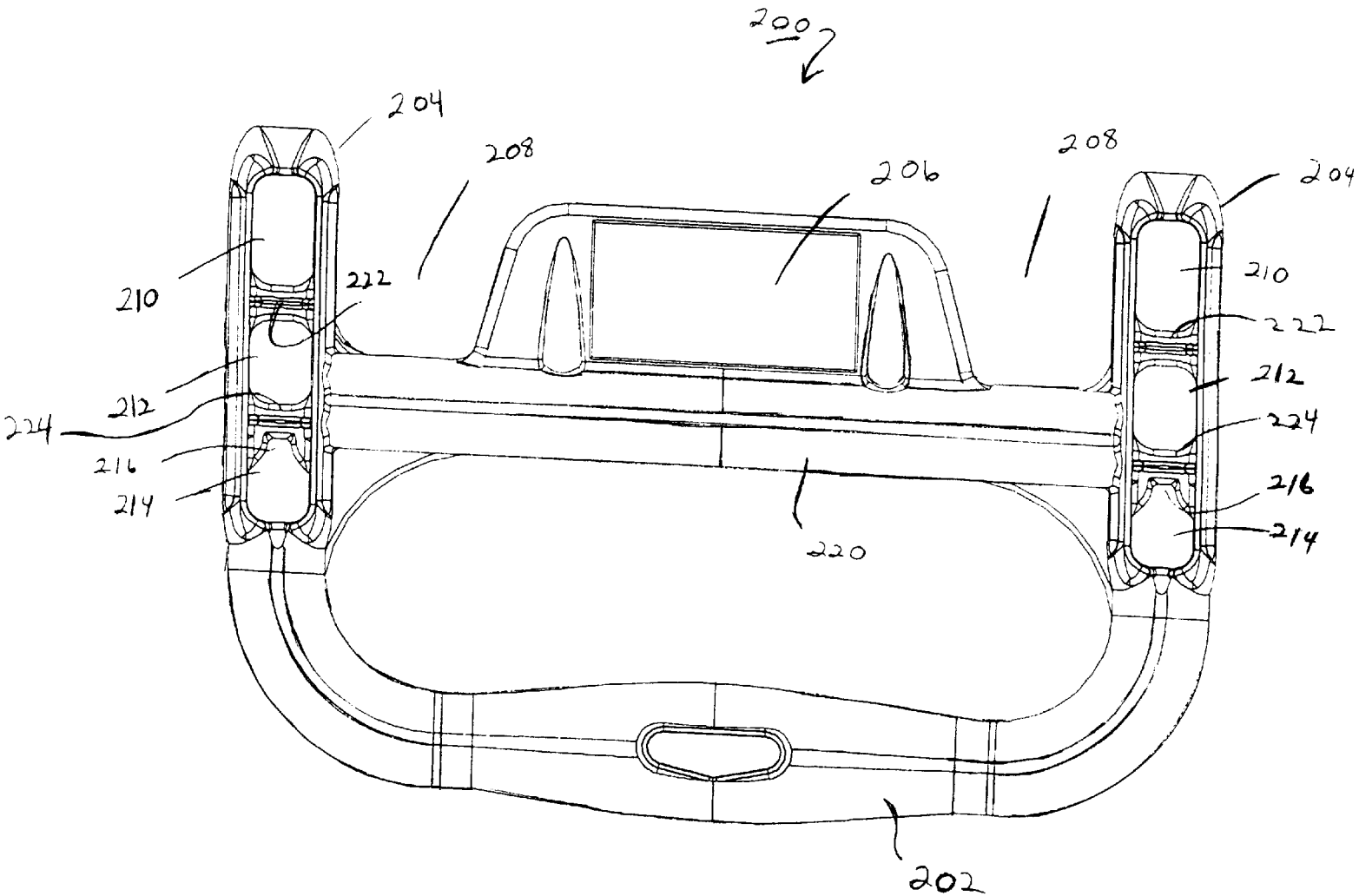
FIG. 30 is an elevated view of a handle having anchor portion formed therein in accordance with another embodiment of the present invention.
Figure 31:
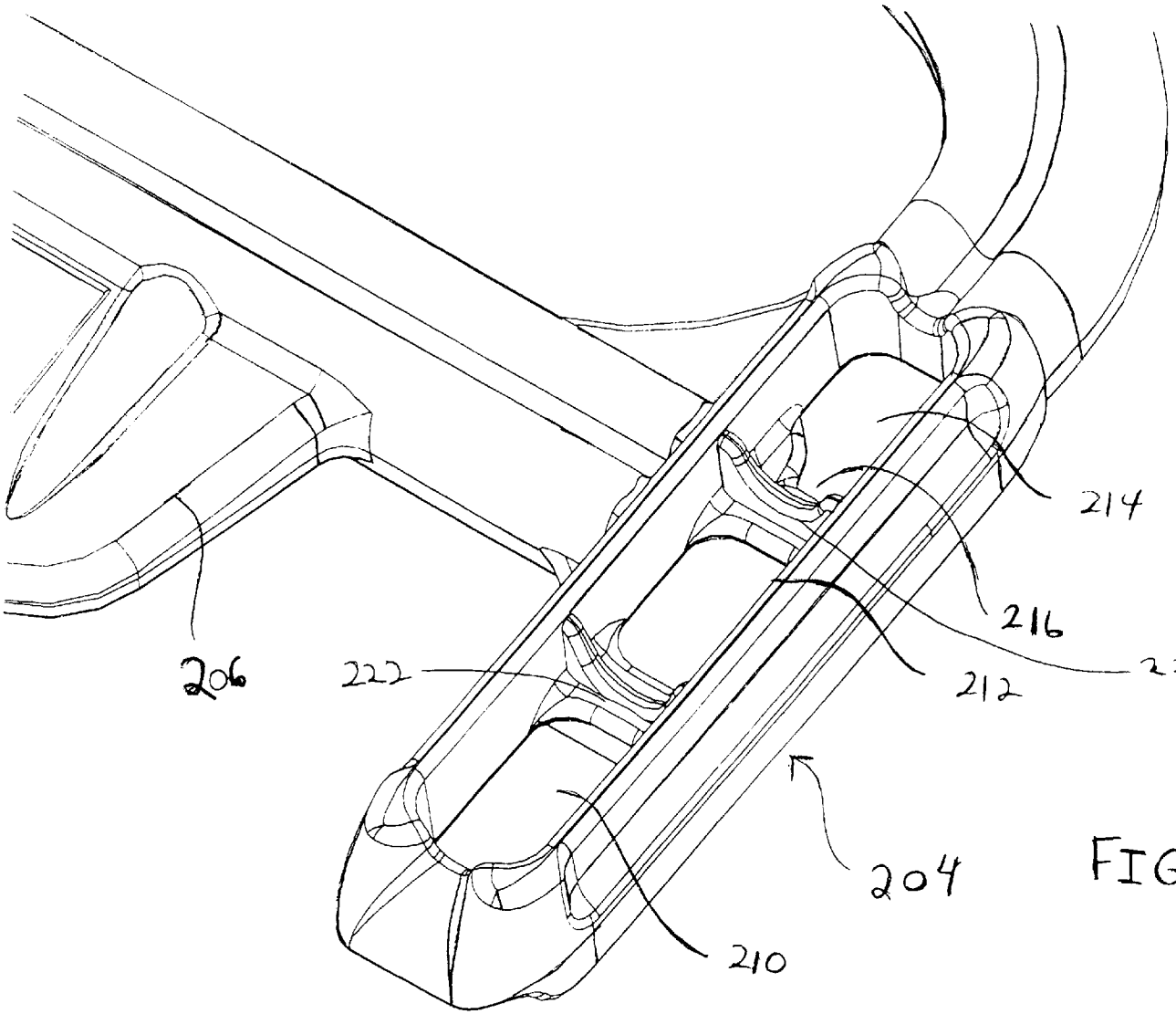
FIG. 31 is a magnified perspective view of the anchor portions in FIG. 30 in accordance with the present invention.

Referring to FIGS. 30 and 31, a particularly useful embodiment of the present invention is shown. A handle 200 includes a grip portion 202 and anchor portions 204. Handle 200 is preferably formed from a plastic or other rigid material, which is preferably capable of withstanding environmental conditions. Anchor portions 204 are configured to receive flexible member 18. A raised tab 206 is adapted to be received by a handle on a receptacle (not shown) such as a trashcan or the like. Tab 206 is preferably bounded by anchor portions 204 so portions of a receptacle handle are received in troughs 208 when handle assembly 200 in use.

Handle 200 is secured to the handle of a receptacle and employed to maintain a cover (not shown) on the receptacle. In one embodiment, handle assembly 200 is employed to keep a cover on a trash receptacle or storage container. Handle assembly 200 may be employed alone if a flexible member (as described above) used with it is secured at an opposing position (e.g., at a location on the receptacle). Otherwise, handle 200 is employed as a pair of assemblies 200 with one handle corresponding to the handles on each side of the receptacle to secure a cover thereon. Tab 206 is secured by a crossbar 220, which adds rigidity and support for handle 200. Handle 200 includes two or more holes (210, 212, 214) in each anchor portion 204 to receive and secure a flexible member. The present invention also contemplates other hole patterns or hole arrangements for securing flexible member 18.

Figure 32:
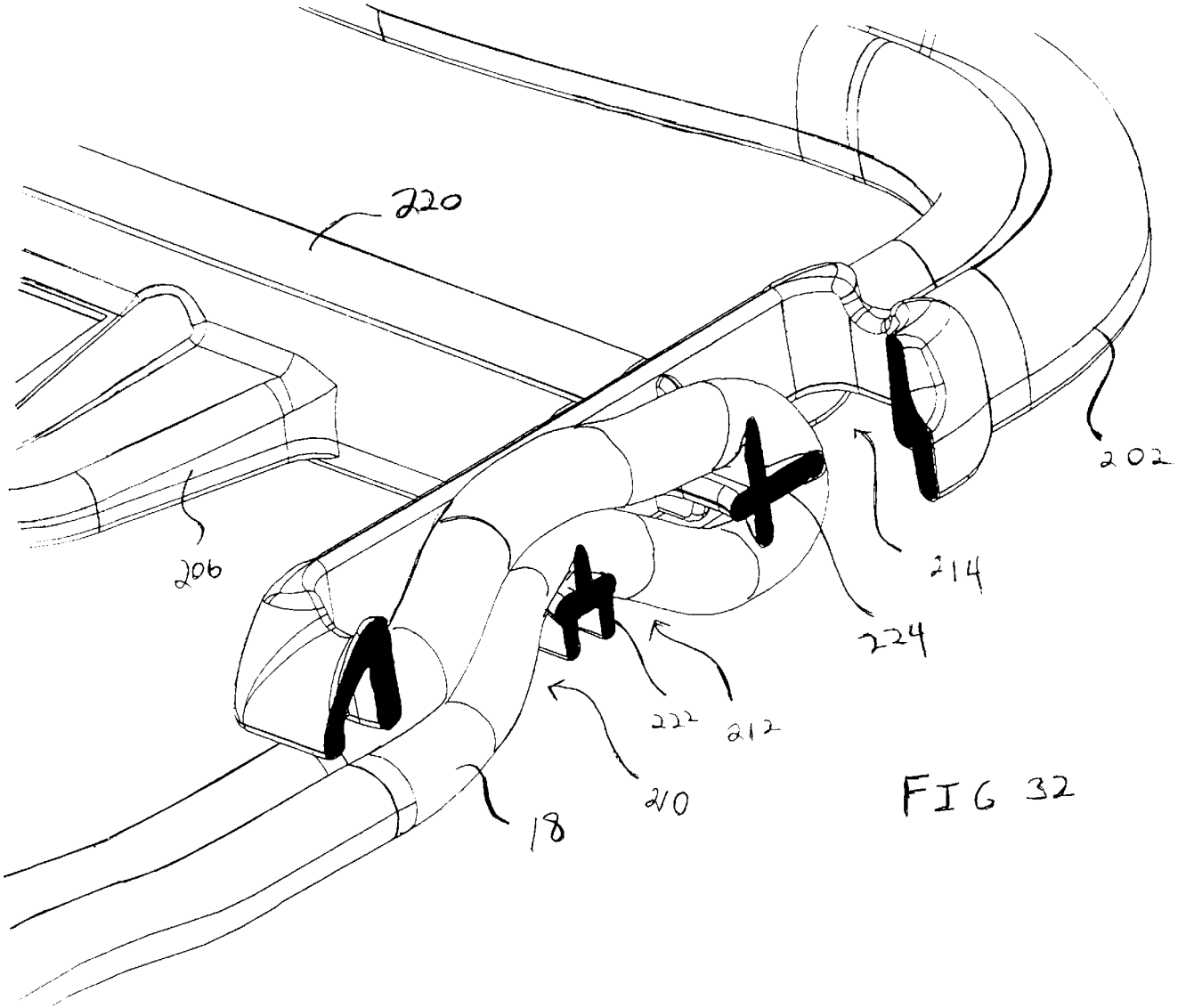
FIG. 32 is a partial magnified cross-sectional view taken through the anchor portion of FIG. 31 in accordance with the present invention.

FIGS. 31 and 32 show holes 210, 212 and 214 in accordance with one embodiment of the present invention. Holes 210, 212 and 214 receive and secure flexible member 18. Flexible member 18 is woven through hole 210 and over a rung 222 into hole 212. Flexible member 18 is doubled back through hole 214 and secured by a v or u groove 216 formed in rung 224. This secures flexible member 18 at a fixed position. Flexible member 18 may be adjusted in length or in tension by partially unweaving flexible member 18 pulling additional length through holes 210, 212 and 214 and then resecuring flexible member 18. By weaving flexible member 18 over rungs 222 and/or 224, frictional forces are developed to prevent pullout of flexible member 18 from anchor portions 204.

Figure 33:
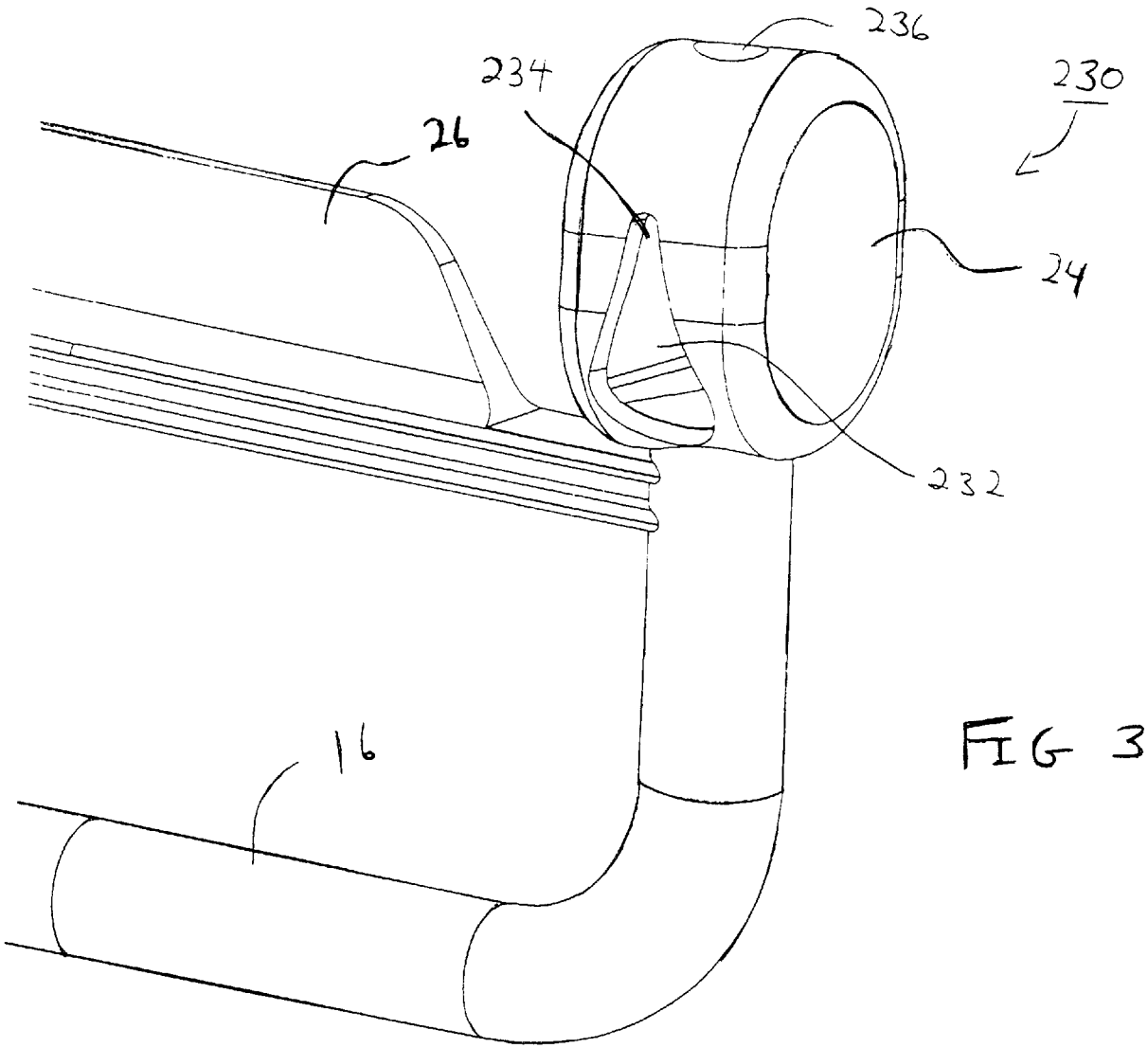
FIGS. 33 and 34 are perspective views of anchor portions without and with a flexible tension member being pinched by a groove to secure the flexible member in accordance with the present invention.
Figure 34:
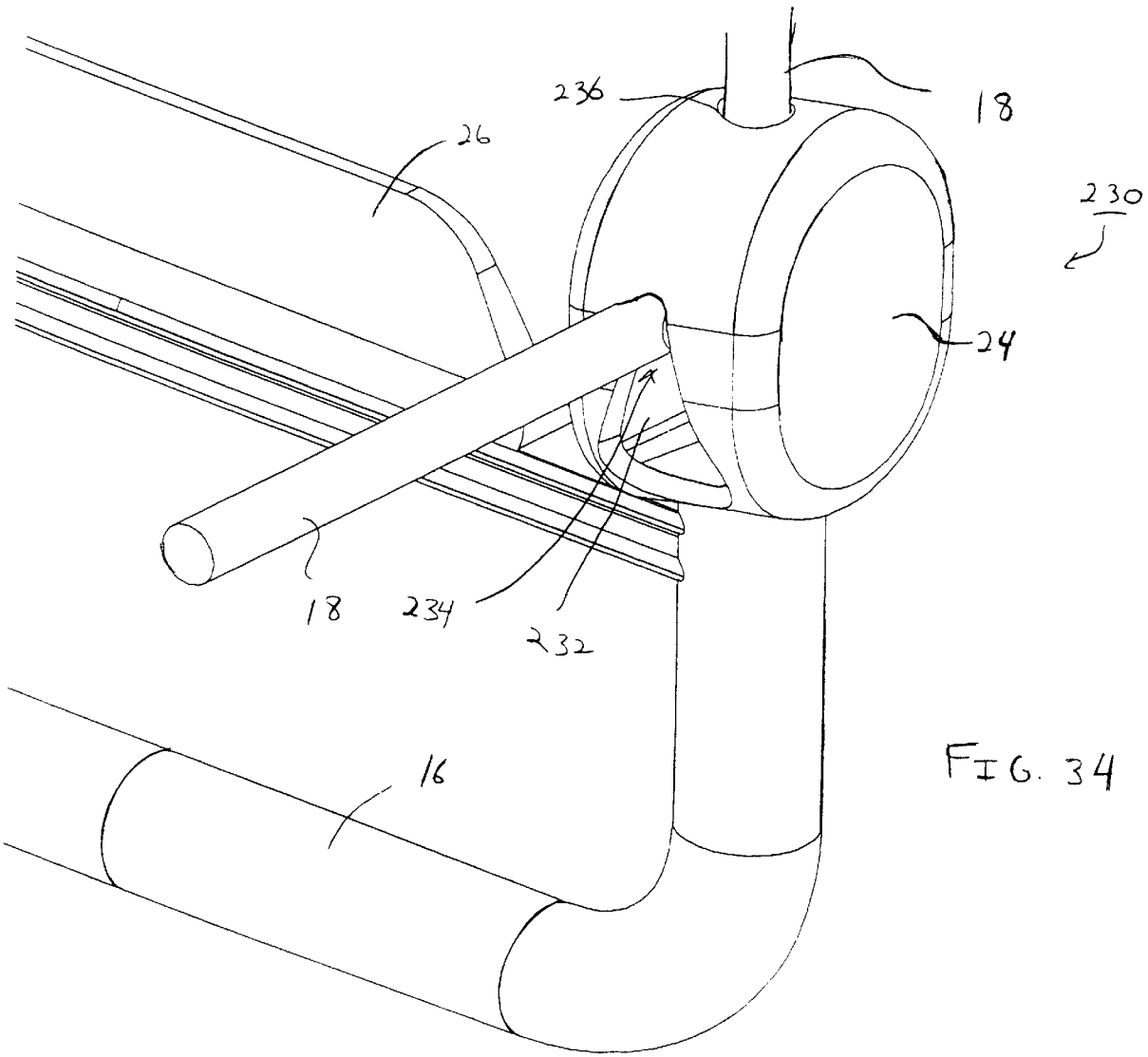

Referring to FIGS. 33 and 34, a handle assembly 230 includes anchor portion 24 having an orifice 232 formed therein. Orifice 232 has a curved triangular shape with an apex 234. In use, a flexible member 18 is threaded through hole 236 and then through orifice 232. Flexible member 18 is pulled to a desired length or tension through a lower open portion of orifice 232. When the desired length or tension is achieved, flexible member 18 is translated or rotated toward apex 234, which pinches flexible member 18 thereby securing member 18 in place. To release or readjust member 18, member 18 is rotated away from apex 234.

Figure 35:
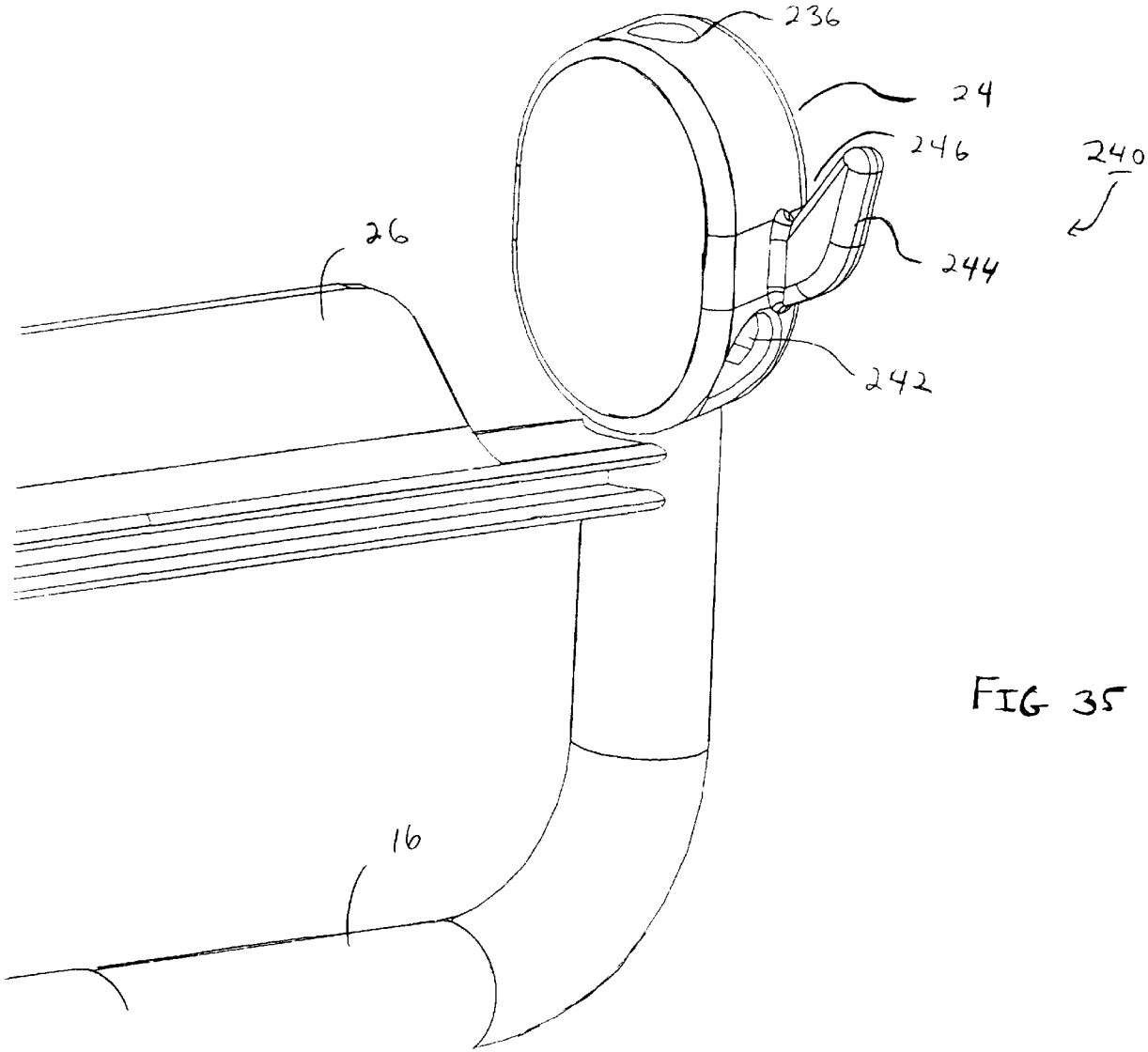
FIGS. 35 and 36 are perspective views of anchor portions without and with a flexible tension member being pinched by a groove formed by an extension to secure the flexible member in accordance with the present invention.
Figure 36:
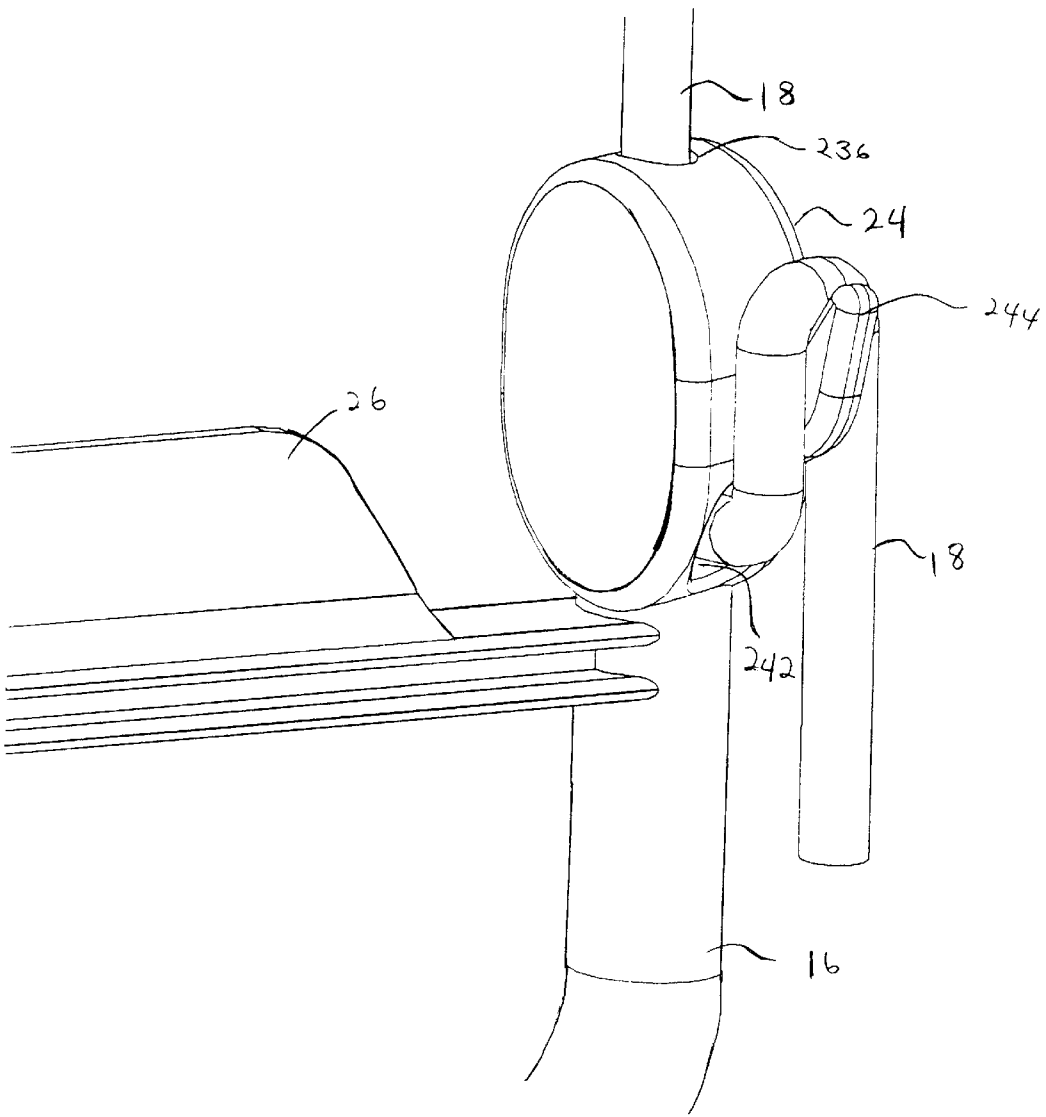

Referring to FIGS. 35 and 36, another embodiment of the present invention includes a handle assembly 240. Assembly 240 includes tab 26 or similar structure for connecting to a handle of a receptacle to secure a cover thereto as described above. Assembly 240 includes anchor portions 24 adapted to receive flexible member 18 therein through hole 236. Next, flexible member 18 is threaded through an orifice 242 and routed over the top of a projection or extended portion 244. Portion 244 forms a v-groove 246, which secures flexible member 18 therein by deforming the circumference of the flexible member 18 using the tension developed in the flexible member 18 as a result of stretching the flexible member 18. V-groove 246 may include pointed, surfaced or reduced area portions to provide additional frictional force against member 18.

To adjust or release flexible member 244, flexible member 18 is removed from v-groove 246 and slack may be developed in flexible member 18 to readjust flexible member 18 through hole 236 and orifice 242. Flexible member 18 may then be resecured as needed.

It is to be understood that anchor portions shown in the FIGS. may be of the same design or mixed with other types of anchor portions on a single handle assembly. For example, one anchor portion 24 from each of assembly 230 and 240 (shown in FIGS. 33 and 35) may be combined on opposite sides a handle assembly.

Figure 37:
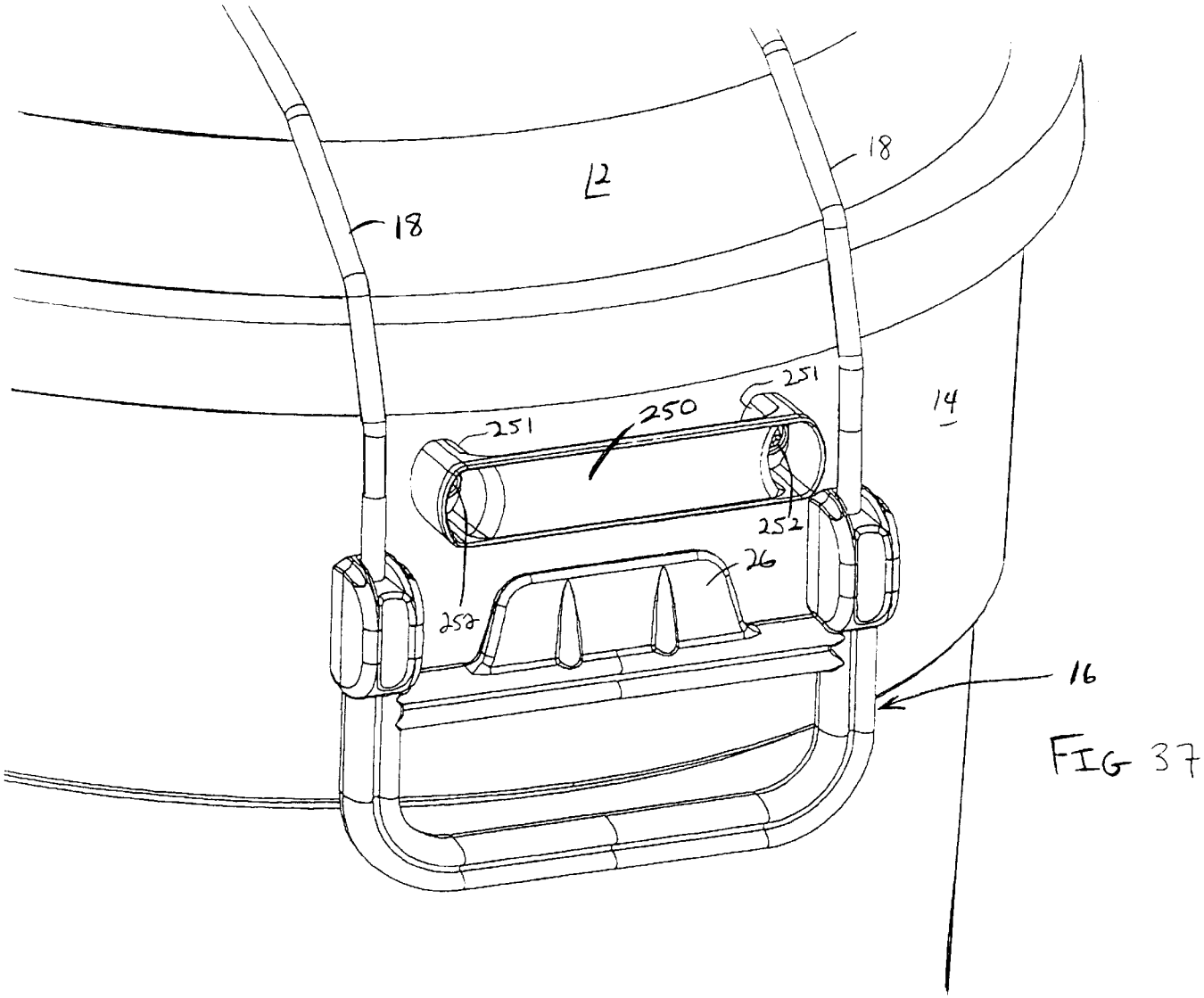
FIG. 37 is a perspective view showing a locking bar, which is attached to a container to permit attachment of a handle assembly in accordance with the present invention.

Referring to FIG. 37, a locking bar 250 may be attached to a container 14 to permit any handle assembly (16) to be connected to container 14. Locking bar 250 may include rounded surfaces 251 to receive tab 26. Locking bar 250 may be attached to container 14 by screws, rivets, adhesive, adhesive tapes or by other means sufficient to withstand the forces imparted on locking bar 250 by flexible member(s) 18 during use. Locking bar 250 may be included in a kit along with hardware for handle assembly(s) 16.

Having described preferred embodiments for cover holder assemblies (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A cover holder, comprising a handle including an engagement structure configured and dimensioned for engaging a container structure provided on a container, the engagement structure extending from a portion of the handle for detachably fitting the container structure; and the handle including anchor portions each having a plurality of holes for receiving at least one flexible tension member to connect the flexible tension member to the handle, the flexible tension member being adjustably connected by weaving the flexible tension member through the plurality of holes, the plurality of holes being arranged to permit the at least one flexible tension member to develop a frictional force to prevent pull out of the flexible tension member from the anchor portions;

the engagement structure for engaging the container structure, and the flexible tension member being arranged on a container cover such that the cover holder removably attaches the container cover on the container.

2. The holder as recited in claim 1, wherein the engagement structure is removable from the handle and replaceable to accommodate different sized container structures.

3. The holder as recited in claim 1, wherein the engagement structure is adjustable to accommodate different sized container structures.

4. The holder as recited in claim 1, wherein the anchor portions include a groove for pinching the flexible tension member.

5. The holder as recited in claim 1, wherein the anchor portions include an extended portion adjacent to one of the plurality of holes, which forms a groove for pinching the flexible tension member.

6. The holder as recited in claim 5, wherein the groove includes a structure to increase friction between the groove and the flexible tension member.

7. The holder as recited in claim 1, wherein the plurality of holes is linearly arranged on each anchor portion.

8. The holder as recited in claim 7, wherein one of the plurality of holes forms a groove for pinching the flexible tension member.

9. A handle, comprising:

an engagement structure configured and dimensioned for engaging a container structure provided on a container, the engagement structure for detachably fitting the container structure;

anchor portions disposed on opposite sides of the engagement structure, each anchor portion including at least two holes, the holes being disposed adjacent to one another; and one of the holes of each anchor portion including a groove for receiving at least one flexible tension member to connect the flexible tension member to the handle, the groove for permitting the at least one flexible tension member to develop a frictional force to prevent pull out of the flexible tension member from the anchor portions, by wrapping the flexible tension member between the at least two holes;

the engagement structure for engaging the container structure, and the flexible tension member being arranged on a container cover such that the cover holder removably attaches the container cover on the container.

10. The handle as recited in claim 9, wherein the engagement structure is removable from the handle and replaceable to accommodate different sized container structures.

11. The handle as recited in claim 10, wherein the engagement structure is adjustable to accommodate different sized container structures.

12. The handle as recited in claim 10, wherein the anchor portions and the engagement structure are configured to form troughs to receive the container structure.

13. The handle as recited in claim 10, wherein the plurality of holes is linearly arranged on each anchor portion.

14. A handle, comprising:

an engagement structure configured and dimensioned for engaging a container structure provided on a container, the engagement structure for detachably fitting the container structure;

the engagement structure having a crossbar connecting to portion of the handle and having a protrusion formed at a mid-section of the crossbar thereby forming grooved sections for receiving portions of the container structure;

anchor portions disposed on opposite sides of the engagement structure, each anchor portion including at least two holes, the holes being disposed adjacent to one another;

one of the holes of each anchor portion including a groove for receiving at least one flexible tension member to connect the flexible tension member to the handle, the groove for permitting the at least one flexible tension member to develop a frictional force to prevent pull out of the flexible tension member from the anchor portions, by wrapping the flexible tension member between the at least two holes;

the engagement structure for engaging the container structure, and the flexible tension member being arranged on a container cover such that the cover holder removably attaches the container cover on the container; and the groove forming a pinch point which pinches the flexible tension member to prevent pull out.

* * * * *